United States Patent [19]

Nagai et al.

[11] Patent Number: 4,723,408

[45] Date of Patent: Feb. 9, 1988

[54] DOUBLE AIR-FUEL RATIO SENSOR SYSTEM CARRYING OUT LEARNING CONTROL OPERATION

[75] Inventors: Toshinari Nagai, Susono; Takatoshi Masui; Yasushi Sato, both of Mishima; Toshiyasu Katsuno, Susono, all of Japan

[73] Assignee: Toyota Jidosha Kabushiki Kaisha, Aichi, Japan

[21] Appl. No.: 904,042

[22] Filed: Sep. 4, 1986

[30] Foreign Application Priority Data

Sep. 10, 1985 [JP] Japan ..... 60-198588
Aug. 27, 1986 [JP] Japan ..... 61-199118

[51] Int. Cl.[4] ..... F02D 41/14

[52] U.S. Cl. ..... 60/274; 60/276; 60/285; 123/489

[58] Field of Search ..... 123/440, 489, 589; 60/276, 285, 274; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler et al. | 123/440 |
| 4,235,204 | 11/1980 | Rice | 123/440 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |
| 4,602,601 | 7/1986 | Kanai | 123/489 |

FOREIGN PATENT DOCUMENTS

| | | |
|---|---|---|
| 58-135343 | 8/1938 | Japan . |
| 52-102934 | 8/1977 | Japan . |
| 53-103796 | 9/1978 | Japan . |
| 55-37562 | 3/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-53661 | 3/1983 | Japan . |
| 58-48755 | 3/1983 | Japan . |
| 58-48756 | 3/1983 | Japan . |
| 58-72646 | 4/1983 | Japan . |
| 58-72647 | 4/1983 | Japan . |
| 58-152147 | 9/1983 | Japan . |
| 58-150038 | 9/1983 | Japan . |
| 58-150039 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar
*Attorney, Agent, or Firm*—Parkhurst & Oliff

[57] ABSTRACT

In a double air-fuel sensor system including two air-fuel ratio sensors upstream and downstream of a catalyst converter provided in an exhaust gas passage, an actual air-fuel ratio is adjusted in accordance with the outputs of the upstream-side and downstream-side air-fuel ratio sensors including an air-fuel ratio correction amount. Accordingly, only when the change of the intake air density is large, is a learning correction amount calculated so that a means value of the air-fuel ratio correction amount is brought close to a reference value. The actual air-fuel ratio is further adjusted in accordance with the learning correction amount.

36 Claims, 50 Drawing Figures

LEARNING CONTROL ROUTINE

FAFAV ← (FAF1+FAF1o)/2
401
FAF1o ← FAF1
402
ΔFAF ← FAFAV-1.0
403
ΔFAF > A ?
404
YES
NO
ΔFAF < -A ?
405
YES
NO
416
C ← C+1
418
C ← 0
419
C ← C+1
417
C > Co ?
NO
YES
420
C > Co ?
NO
YES
413
FSFB ← "0"
414
FSFB ← "1"
415
FSFB ← "0"
406
FGHAC ← FGHAC+ΔFGHAC
409
FGHAC ← FGHAC-ΔFGHAC
407
FGHAC > 1.05 ?
NO
YES
408
FGHAC ← 1.05
410
FGHAC < 0.9 ?
NO
YES
411
FGHAC ← 0.9
RETURN
412

| Fig. 6 A | Fig. 6 B | Fig. 6 C |
|---|---|---|

V
1
0
V1
VR1
RICH
LEAN
TDR1
(-TDL1)
F1
KIR
RSL
FAF1
RSR
KIL
V2
VR2
LEAN
RICH
(-TDL2)
TDR2
F2
KI2
RS2
FAF2
RS2
KI2
RS2

| Fig. 10A | Fig. 10B |
|---|---|

V
1
0
V1
VR1

RICH
LEAN

TDR1
(-TDL1)
F1

KIR
RSL
FAF1
RSR
KIL

V
1
0
V2
VR2

LEAN
RICH
(-TDL2)
TDR2

F2

MAX
RSR
MIN

MAX
RSL
MIN

DOUBLE AIR-FUEL RATIO SENSOR SYSTEM CARRYING OUT LEARNING CONTROL OPERATION

BACKGROUND OF THE INVENTION (1) Field of the Invention

The present invention relates to a method and apparatus for feedback control of an air-fuel ratio in an internal combustion engine having two air-fuel ratio sensors upstream and downstream of a catalyst converter disposed within an exhaust gas passage.

(2) Description of the Related Art

Generally, in a feedback control of the air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio.

According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_X$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. Nos. 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor is addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream side $O_2$ sensor.

(3) On the downstream side of the catalyst converter, the exhaust gas is mixed so that the concentration, of oxygen in the exhaust gas is approximately in an equilibrium state.

Therefore, according to the double $O_2$ sensor system, the fluctuation of the output of the upstream-side $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, however, the air-fuel ratio correction coefficient FAF may be greatly deviated from a reference value such as 1.0 due to individual differences in the characteristics of the parts of the engine, individual changes caused by aging, environmental changes, and the like. For example, when driving at a high altitude (above sea level), the air-fuel ratio correction coefficient FAF is remarkably reduced, thereby obtaining an optimum air-fuel ratio such as the stoichiometric air-fuel ratio. In this case, a maximum value and a minimum value are imposed on the air-fuel ratio correction coefficient FAF, thereby preventing the controlled air-fuel ratio from becoming overrich or overlean. Therefore, when the air-fuel ratio correction coefficient FAF is close to the maximum value or the minimum value, the margin of the air-fuel ratio correction coefficient FAF becomes small, thus limiting the compensation of a transient change of the controlled air-fuel ratio. Also, when the engine is switched from an air-fuel ratio feedback control (closed-loop control) by the upstream-side and downstream-side $O_2$ sensors to an open-loop control, the air-fuel ratio correction coefficient FAF is made the reference value (=1.0), thereby causing an overrich or overlean condition in the controlled air-fuel ratio, and thus deteriorating the fuel consumption, the drivability, and the condition of the exhaust emissions such as HC, CO, and $NO_X$, since the air-fuel ratio correction coefficient FAF (=0.1) during an open-loop control is, in this case, not an optimum level. Further, it takes a long time for the controlled air-fuel ratio to reach an optimum level after the engine is switched from an open control to an air-fuel ratio feedback control by the upstream-side and downstream-side $O_2$ sensors, thus also deteriorating the fuel consumption, the drivability, and the condition of the exhaust emissions.

Accordingly, a learning control operation has been introduced into a double $O_2$ sensor system, so that a mean value of the air-fuel ratio correction coefficient FAF, i.e., a mean value of successive values of the air-fuel ratio correction coefficient FAF immediately before skip operations is always changed around the reference value such as 1.0. Therefore, the margin of the air-fuel ratio correction coefficient FAF is always large, and accordingly, a transient change in the controlled air-fuel ratio can be compensated. Also, a difference in the air-fuel ratio correction coefficient FAF between an air-fuel ratio feedback control and an open-loop control becomes small. As a result, the deviation of the controlled air-fuel ratio in an open-loop control from its optimum level is small, and in addition, the controlled air-fuel ratio promptly reaches an optimum level after the engine is switched from an open-loop control to an air-fuel ratio feedback control.

In the above-mentioned learning control operation, a learning value FGHAC is calculated so that the mean value FAFAV of the air-fuel ratio correction coefficient FAF is brought close to the reference value such as 1.0. This learning control operation originally responds to a change of density of the air intake into the engine such as when driving at a high altitude. Therefore, a maximum value and a minimum value are also imposed on the learning value FGHAC, thereby preventing the controlled air-fuel ratio from becoming overrich or overlean due to the operation of an evaporation system. In a double $O_2$ sensor system, however, the base air-fuel ratio is controlled by changing the deviation of the air-fuel ratio correction coefficient FAF from the reference value such as 1.0. Accordingly, since the mean value FAFAV of the air-fuel ratio correction coefficient FAF is changed by the air-fuel ratio feedback control by the downstream-side $O_2$ sensor even when no change occurs in the intake air density, the learning value FGHAC is changed and brought close to the maximum value or minimum value thereof. Therefore, in this case, the margin of the learning value FGHAC becomes small, and even when a change occurs in the intake air density, compensation of the change of the intake air density may be impossible, thus also deteriorating the fuel consumption, the drivability, and the condition of the exhaust emissions.

SUMMARY OF THE INVENTION

It is an object of the present invention to provide a double air-fuel ratio sensor system in an internal combustion engine in which a learning control operation is properly carried out when the intake air density is changed.

According to the present invention, in a double air-fuel sensor system including two air-fuel ratio sensors upstream and downstream of a catalyst converter provided in an exhaust gas passage, an actual air-fuel ratio is adjusted in accordance with the outputs of the upstream-side and downstream-side air-fuel ratio sensors including an air-fuel ratio correction amount. Accordingly, only when the change of the intake air density is large, is a learning correction amount calculated so that a mean value of the air-fuel ratio correction amount is brought close to a reference value. The actual air-fuel ratio is further adjusted in accordance with the learning correction amount.

BRIEF DESCRIPTION OF THE DRAWINGS

The present invention will be more clearly understood from the description as set forth below with reference to the accompanying drawings, wherein:

FIGS. 3, 3A, 3B, 3C, 4A, 4B, 4C, 6, 6A, 6B, 6C, 7, 8, 10, 10A, 10B, 11, 12, 15, and 17 are flow charts showing the operation of the control circuit of FIG. 2;

DESCRIPTION OF THE PREFERRED EMBODIMENTS

Figure 1:
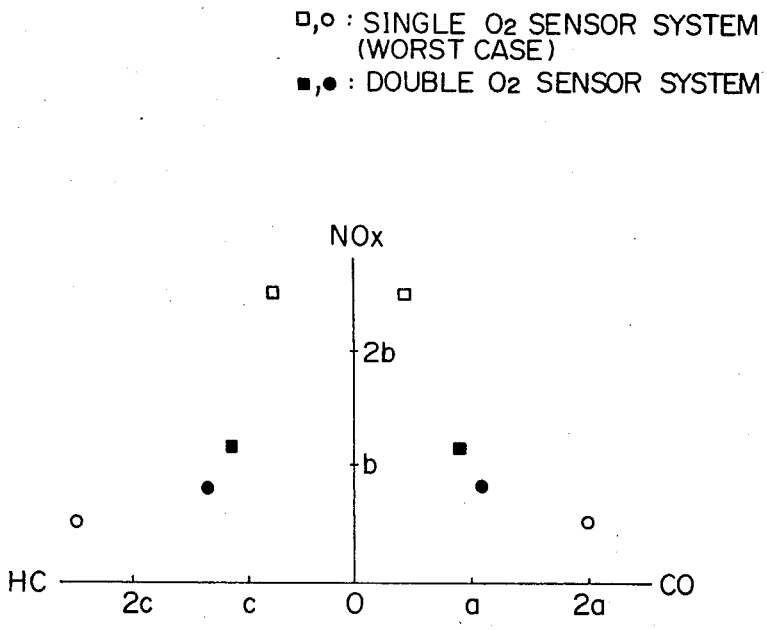
FIG. 1 is a graph showing the emission characteristics of a single $O_2$ sensor system and a double $O_2$ sensor system.
Figure 2:
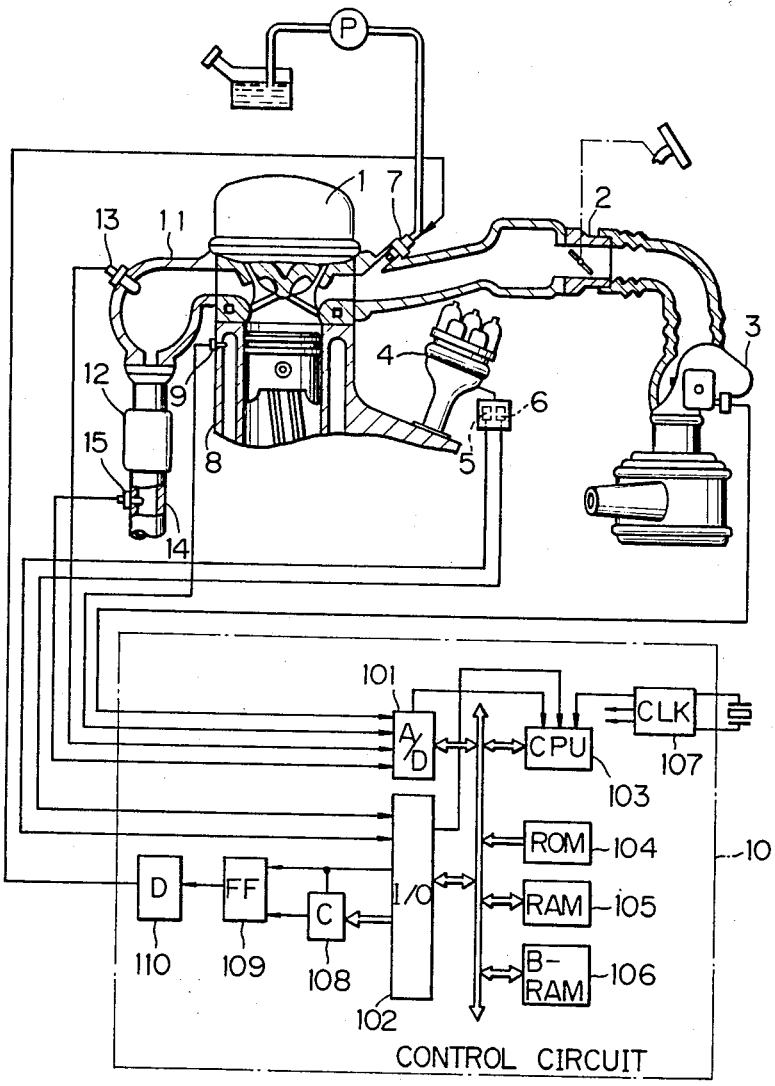
FIG. 2 is a schematic view of an internal combustion engine according to the present invention.

In FIG. 2, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air taken into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1.

In this case, the crank-angle sensor 5 generates a pulse signal at every 720° crank angle (CA) while the crank-angle sensor 6 generates a pulse signal at every 30° CA. The pulse signals of the crank angle sensors 5 and 6 are supplied to an input/output (I/O) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, though not shown in FIG. 2.

Disposed in a cylinder block 8 of the engine 1 is a coolant temperature sensor 9 for detecting the temperature of the coolant. The coolant temperature sensor 9 generates an analog voltage signal in response to the temperature THW of the coolant and transmits it to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_X$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit them to the A/D converter 101 of the control circuit 10.

The control circuit 10, which may be constructed by a microcomputer, further comprises a central processing unit (CPU) 103, a read-only memory (ROM) 104 for storing a main routine, interrupt routines such as a fuel injection routine, an ignition timing routine, tables (maps), constants, etc., a random access memory 105 (RAM) for storing temporary data, a backup RAM 106, an interface 102 of the control circuit 10.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is never erased even when the ignition switch (not shown) is turned off.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature data THW of the coolant sensor 9 are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA, i.e., at every pulse signal of the crank angle sensor 6, and is then stored in the RAM 105.

The operation of the control circuit 10 of FIG. 2 will be now explained.

Figure 3A:
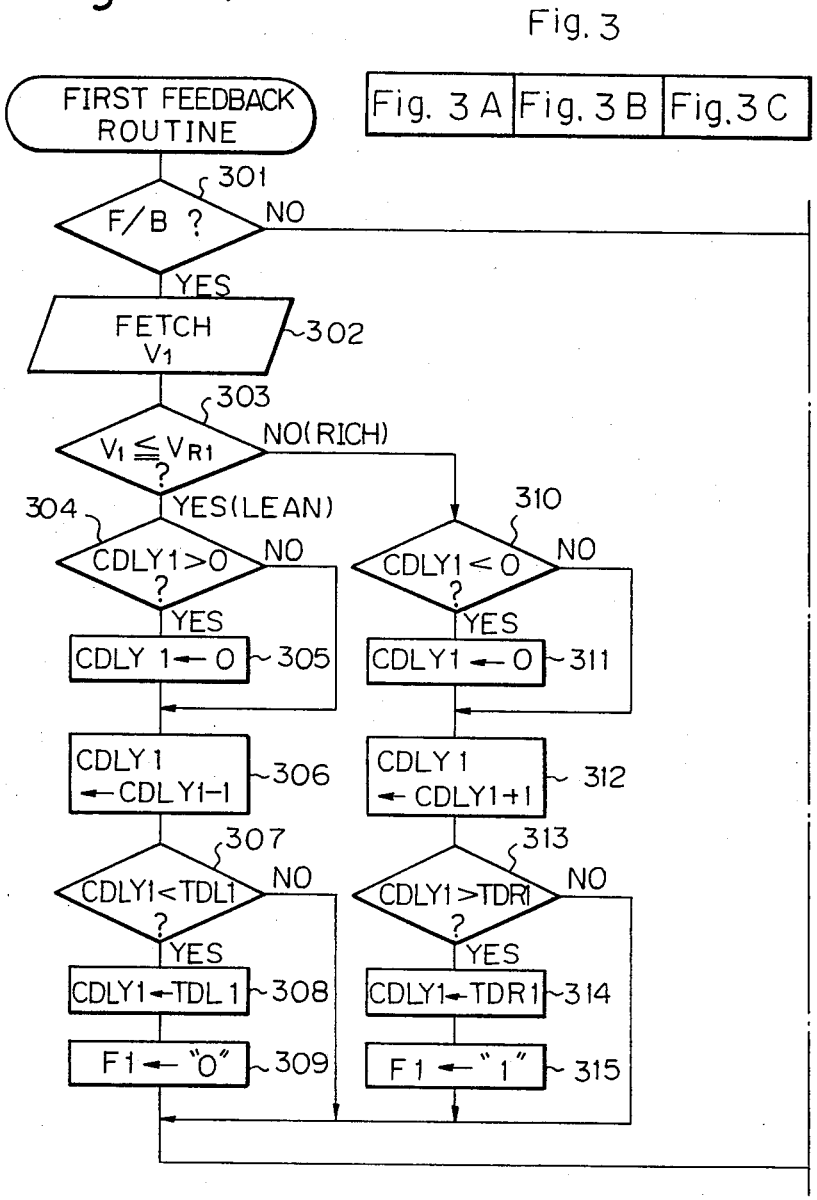
Figure 3B:
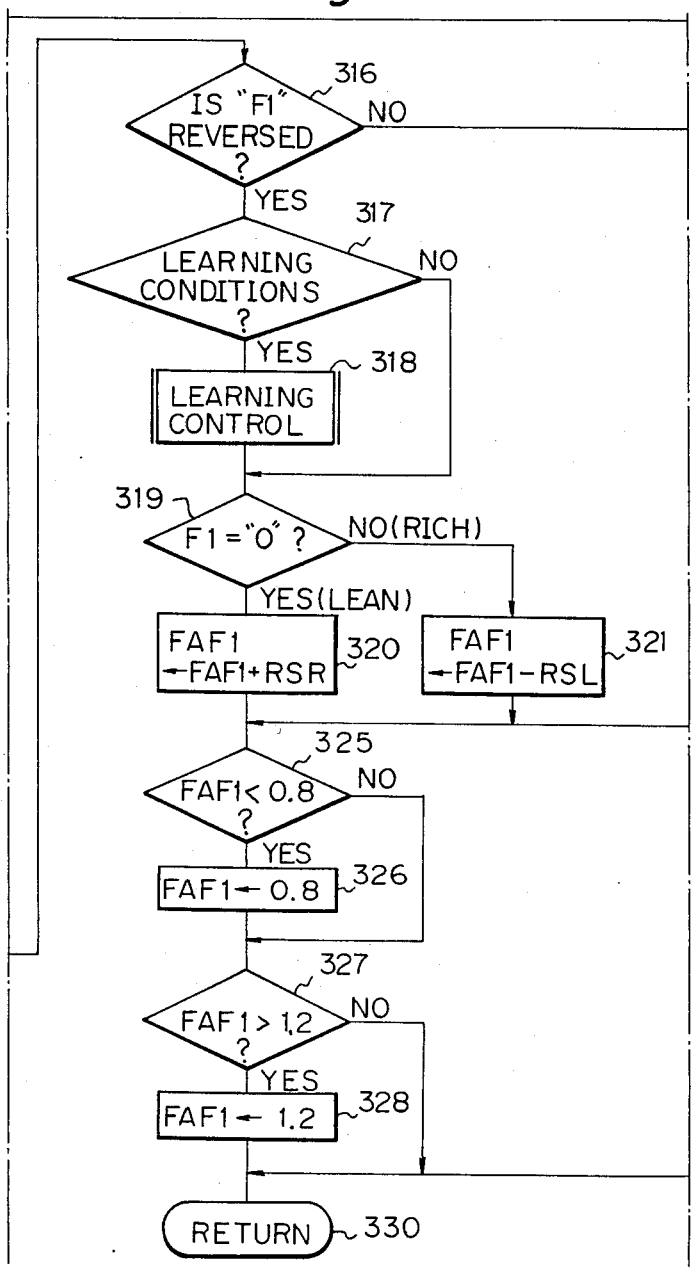
Figure 3C:
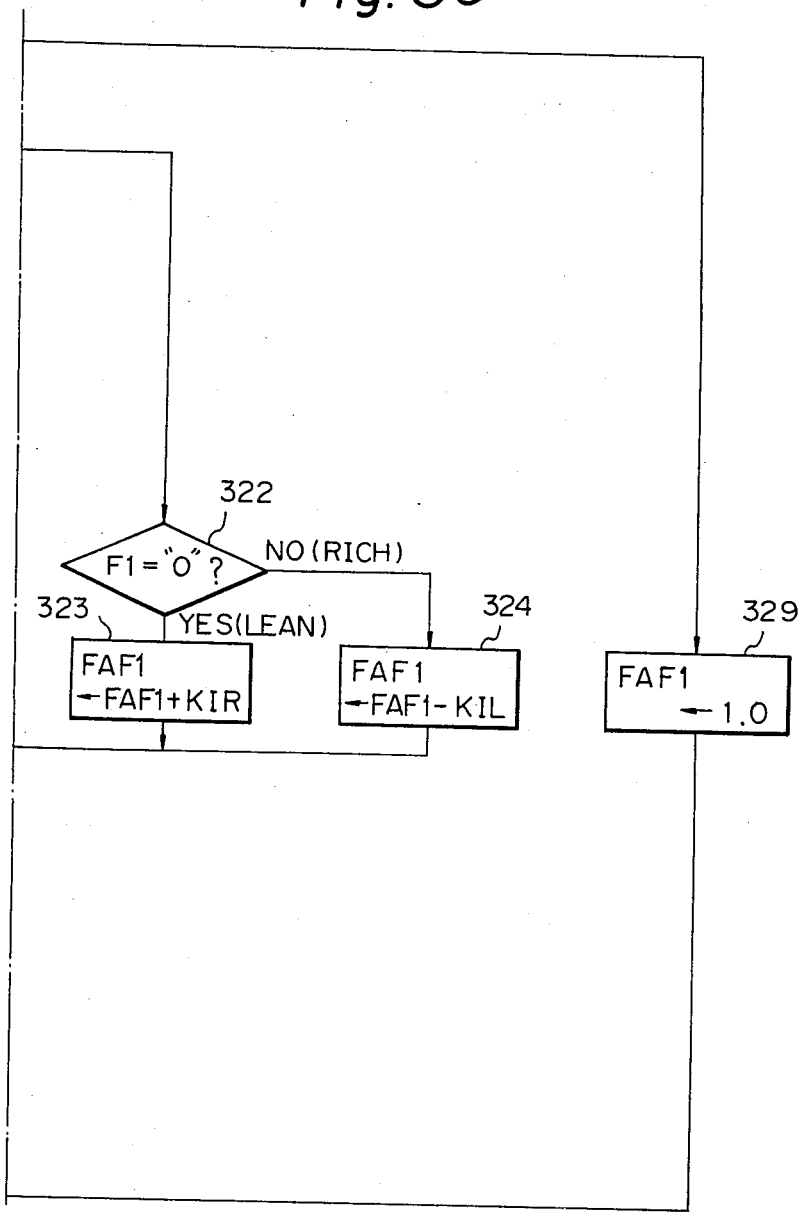

FIG. 3 is a routine for calculating a first air-fuel ratio feedback correction amount FAF1 in accordance with the output of the upstream-side $O_2$ sensor 13 executed at every predetermined time period such as 4 ms.

At step 301, it is determined whether or not all the feedback control (closed-loop control) conditions by the upstream-side $O_2$ sensor 13 are satisfied. The feedback control conditions are as follows:

(i) the engine is not in a starting state;

(ii) the coolant temperature THW is higher than 50° C.;

(iii) the power fuel incremental amount FPOWER is 0; and (iv) the upstream-side $O_2$ sensor 13 is in an activated state.

Note that the determination of activation/non-activation of the upstream-side $O_2$ sensor 13 is carried out by determining whether or not the coolant temperature THW≧70° C., or by whether of not the output of the upstream-side $O_2$ sensor 13 is once swung, i.e., one changed from the rich side to the lean side, or vice versa. Of course, other feedback control conditions are introduced as occasion demands. However, an explanation of such other feedback control conditions is omitted.

If one or more of the feedback control conditions is not satisfied, the control proceeds to step 329, in which the amount FAF1 is made 1.0 (FAF1=1.0), thereby carrying out an open-loop control operation.

Contrary to the above, at step 301, if all of the feedback control conditions are satisfied, the control proceeds to step 302.

At step 302, an A/D conversion is performed upon the output voltage $V_1$ of the upstream-side $O_2$ sensor 13, and the A/D converted value thereof is then fetched from the A/D converter 101. Then at step 303, the voltage $V_1$ is compared with a reference voltage $VR_1$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq = VR_1$, which means that the current air-fuel ratio is lean, the control proceeds to step 304, which determines whether or not the value of a first delay counter CDLY1 is positive. If CDLY1>0, the control proceeds to step 305, which clears the first delay counter CDLY1, and then proceeds to step 306. If CDLY1≦0, the control proceeds directly to step 306. At step 306, the first delay counter CDLY1 is counted down by 1, and at step 307, it is determined whether or not CDLY1>TDL1 . Note that TDL1 is a lean delay time period for which a rich state is maintained even after the output of the upstream-side $O_2$ sensor 13 is changed from the rich side to the lean side, and is defined by a negative value. Therefore, at step 307, only when CDLY1<TDL1 does the control proceed to step 308, which causes CDLY1 to be TDL1, and then to step 309, which causes a first air-fuel ratio flag F1 to be "0" (lean state). On the other hand, if $V_1 > V_{R1}$, which means that the current air-fuel ratio is rich, the control proceeds to step 310, which determines whether or not the value of the first delay counter CDLY1 is negative. If CDLY1<0 , the control proceeds to step 311, which clears the first delay counter CDLY1, and then proceeds to step 312. If CDLY1>0, the control directly proceeds to 312. At step 312, the first delay counter CDLY1 is counted up by 1, and at step 313, it is determined whether or not CDLY1>TDR1. Note that TDR1 is a rich delay time period for which a lean state is maintained even after the output of the upstream-side $O_2$ sensor 13 is changed from the lean side to the rich side, and is defined by a positive value. Therefore, at step 313, only when CDLY1>TDR1 does the control proceed to step 314, which causes CDLY1 to be TDR1, and then to step 315, which causes the first air-fuel ratio flag F1 to be "1" (rich state).

Next, at step 316, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed, the control proceeds to steps 317 to 321, which carry out a learning control operation and a skip operation.

That is, at step 317, it is determined whether or not all the learning control conditions are satisfied. The learning control conditions are as follows:

(i) the coolant temperature THW is higher that 70° C. and lower than 90° C.; and (ii) the deviation ΔQ of the intake air amount is smaller than a predetermined value.

Of course, other learning control conditions are also introduced as occasion demands. If one or more of the learning control conditions are not satisfied, the control proceeds to step 319, and if all the learning control conditions are satisfied, the control proceeds to step 318 which carries out a learning control operation, which will be explained later with reference to FIGS. 4A, 4B, and 4C.

At step 319, if the flag F1 is "0" (lean) the control proceeds to step 320, which remarkably increases the correction amount FAF by a skip amount RSR. Also, if the flag F1 is "1" (rich) at step 517, the control proceeds to step 321, which remarkably decreases the correction amount FAF by the skip amount RSL.

On the other hand, if the first air-fuel ratio flag F1 is not reversed at step 316, the control proceeds to step 322 to 324, which carries out an integration operation. That is, if the flag F1 is "0" (lean) at step 322, the control proceeds to step 323, which gradually increases the correction amount FAF1 by a rich integration amount KIR. Also, if the flag F1 is "1" (rich) at step 322, the control proceeds to step 324, which gradually decreases the correction amount FAF1 by a lean integration amount KIL.

The correction amount FAF1 is guarded by a minimum value 0.8 at steps 325 and 326, and by a maximum value 1.2 at steps 327 and 328, thereby also preventing the controlled air-fuel ratio from becoming overrich or overlean.

The correction amount FAF1 is then stored in the RAM 105, thus completing this routine of FIG. 3 at step 330.

The learning control at step 318 of FIG. 3 is explained with reference to FIG. 4A.

At step 401, a mean value FAFAV of the air-fuel ratio correction coefficient FAF is calculated by $$FAFAV \leftarrow (FAF1 + FAF1_0)/2$$

Where $FAF1_0$ is a value of the air-fuel ratio correction coefficient FAF1 fetched previously at a skip operation. That is, the mean value FAFAV is a mean value of two successive values of the air-fuel ratio correction coefficient FAF1 immediately before the skip operations. Note that the mean value FAFAV can be obtained by four or more successive maximum and minimum values of the air-fuel ratio correction coefficient FAF1.

At step 402, in order to prepare the next execution $$FAF1_0 \leftarrow FAF1$$

At step 403, a difference between the mean value FAFAV and a reference value, which, in this case, is a definite value such as 1.0 corresponding to the stoichiometric air-fuel ratio, is calculated by:

$$\Delta FAF \leftarrow FAFAV - 1.0$$

Note that the definite value 1.0 is the same as the value of the air-fuel ratio correction coefficient FAF1 in an open-loop control by the upstream-side $O_2$ sensor 13 (see step 329 of FIG. 3).

At step 404, it is determined whether or not the difference ΔFAF is larger than a definite value A, and at step 405, it is determined whether or not the difference ΔFAF is smaller than a definite value −A. Note that A is, for example, 0.03. As a result, if ΔFAF>A, then the base air-fuel ratio before the execution of the next skip operation is too rich, so that, at step 406, a learning correction amount FGHAC is increased by $$FGHAC \leftarrow FGHAC + \Delta FGHAC$$

where ΔFGHAC is a definite value. Then, the learning correction amount FGHAC is guarded by a maximum value 1.05 at steps 407 and 408 and is stored in the backup RAM 106. Contrary to this, if ΔFAF<−A, then the base air-fuel ratio before the execution of the next skip operation is too lean, so that, at step 409, the learning correction amount FGHAC is decreased by $$FGHAC \leftarrow FGHAC - FGHAC.$$

Then, the learning correction amount FGHAC is guarded by a minimum value 0.9 at steps 410 and 411, and is stored on the backup RAM 106.

Further, if −A≦ΔFAF≦A, the control proceeds directly to step 412, so that the learning correction amount FGHAC is not changed. Note that the range of ΔFAF defined at step 404 can be changed as occasion demands.

Figure 4A:
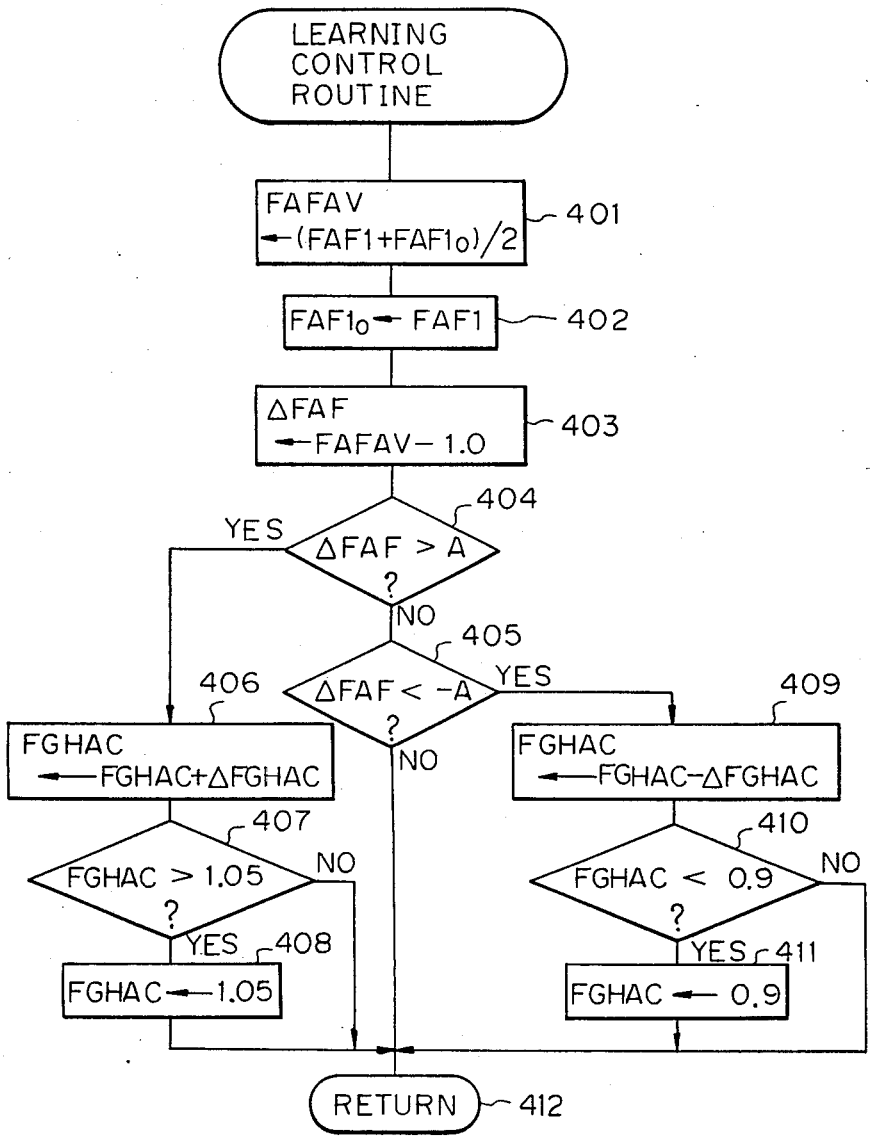

According to the routine of FIG. 4A, only when the difference ΔFAF between the mean value FAFAV of the air-fuel ratio correction coefficient FAF1 and the reference value such as 1.0 is larger than the definite value A, is a substantial learning operation carried out. For example, the difference ΔFAF is at most about 3% due to individual changes of the fuel injection value and the like, while the difference ΔFAF is about 5% due to driving at a high altitude. Therefore, if the definite value A is 0.03, a learning control operation is not performed upon the difference ΔFAF caused by the double $O_2$ sensor system, thereby preventing the learning correction amount FGHAC from being close to the maximum or minimum value thereof. That is, in the routine of FIG. 4A, a change in the intake air density is detected by the difference ΔFAF between the means value FAFAV of the air-fuel ratio correction coefficient FAF1 and the definite value.

Note that such a change in the intake air density can be also detected by a change of the means value FAFAV. In this case, at step 403, a change ΔFAFAV is calculated by $$\Delta FAFAV \leftarrow FAFAV - FAFAV0$$

where FAFAV is a value of the mean value FAFV of the air-fuel ratio correction coefficient FAF1 previously calculated. Also, at step 404, it is determined whether or not ΔFAFAV>B (definite value), and at step 405, it is determined whether or not ΔFAFAV<−B.

Figure 4B:
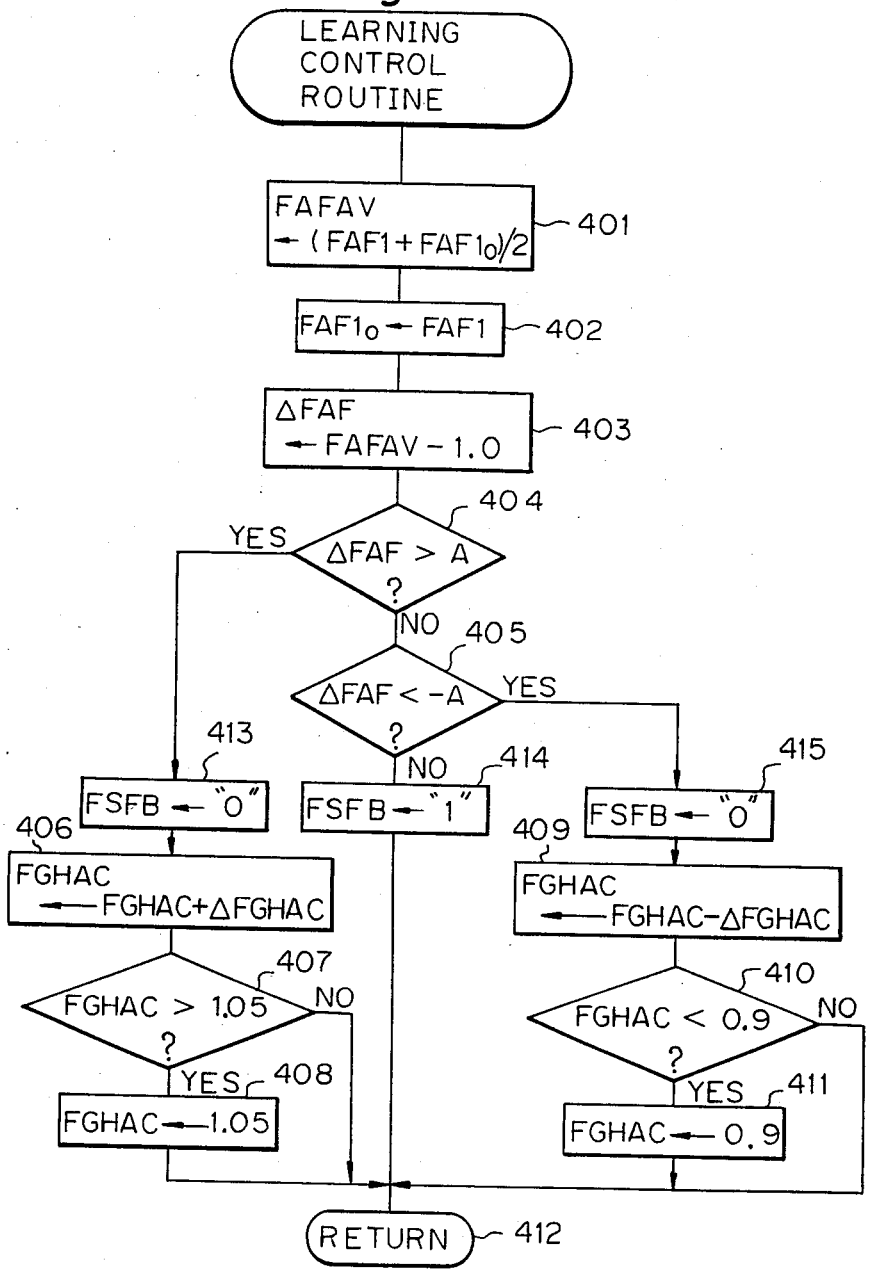

In FIG. 4B, which is a modification of FIG. 4A, steps 413, 414, and 415 are added to FIG. 4A. That is, if ΔFAF>A at step 404 or if ΔFAF<−A, the control proceeds to step 413 or 415 which causes an air-fuel ratio feedback control execution flag FSFB to be "0", while if −A≦ΔFAF≦A, the control proceeds to step 414 which causes the execution flag FSFB to be "1". Note that this execution flag FSFB is used for carrying out an air-fuel ratio feedback control operation by the downstream-side $O_2$ sensor 15, which will be later explained in detail.

Thus, when $|\Delta FAF| > A$, a substantial learning operation for renewing the learning correction amount FGHAC is carried out, however, the air-fuel ratio feedback control operation by the downstream-side $O_2$ sensor 15 is prohibited.

Figure 4C:
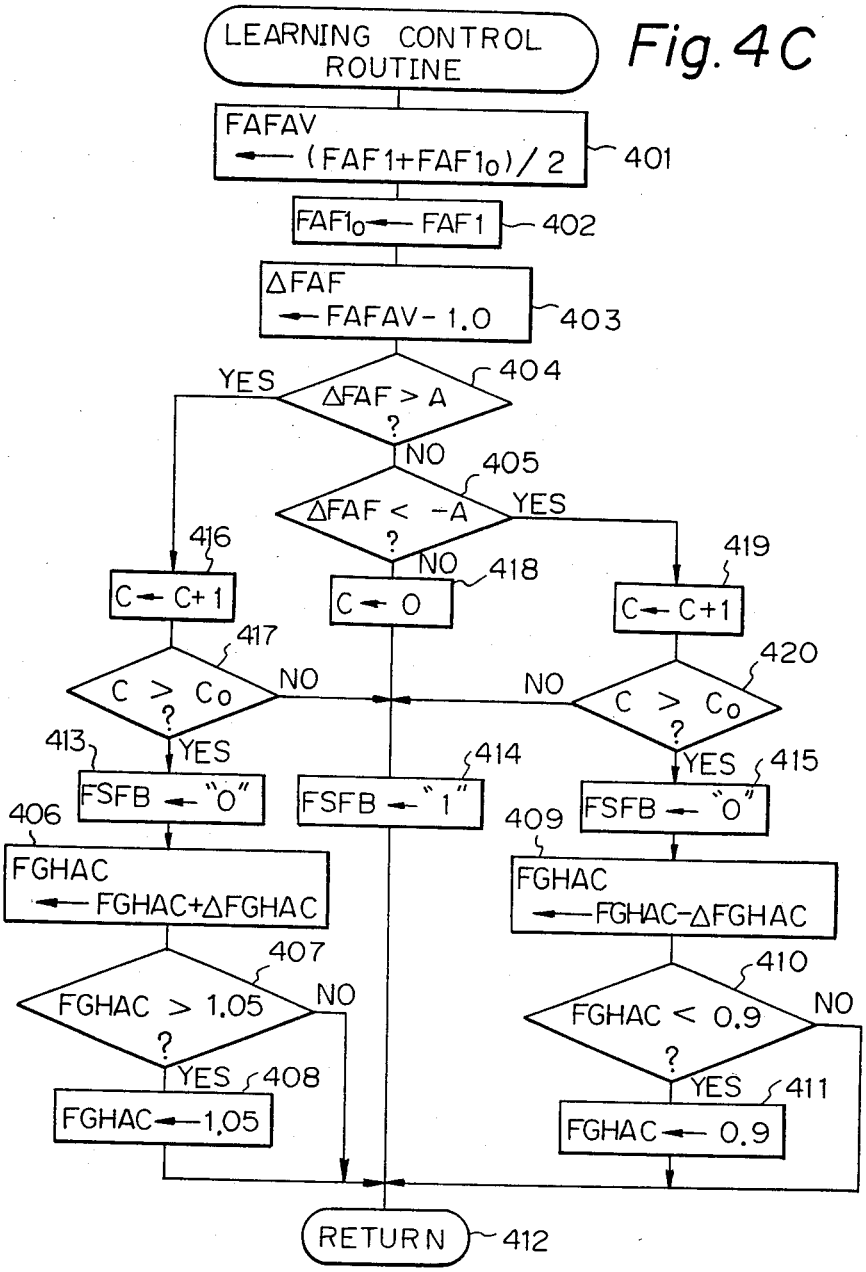

In FIG. 4C, which is a modification of FIG. 4B, steps 416 through 420 are added to FIG. 4B. That is, a counter C is introduced for measuring a duration where $|\Delta FAF| > A$. That is, if $-A \leqq \Delta FAF \leqq A$, at step 418, the counter C is cleared. Contrary to this, if $\Delta FAF > A$ at step 404 or if $\Delta FAF < -A$ at step 405, the control proceeds to step 416 or 419 which counts up the counter C by 1. As a result, only when $C > C_0$ at step 417 or 420 does the control proceed to step 413 or 415, thereby prohibiting the air-fuel ratio feedback control by the downstream-side $O_2$ sensor 15, and further carrying out a substantial learning operation.

That is, the introduction of the counter C is made to delay the determination result at steps 404 and 405, thereby accurately detecting a change of the intake air density.

Note that only steps 416 through 420 of FIG. 4C can be added to FIG. 4A.

Figures 5A, 5B, 5C, 5D:
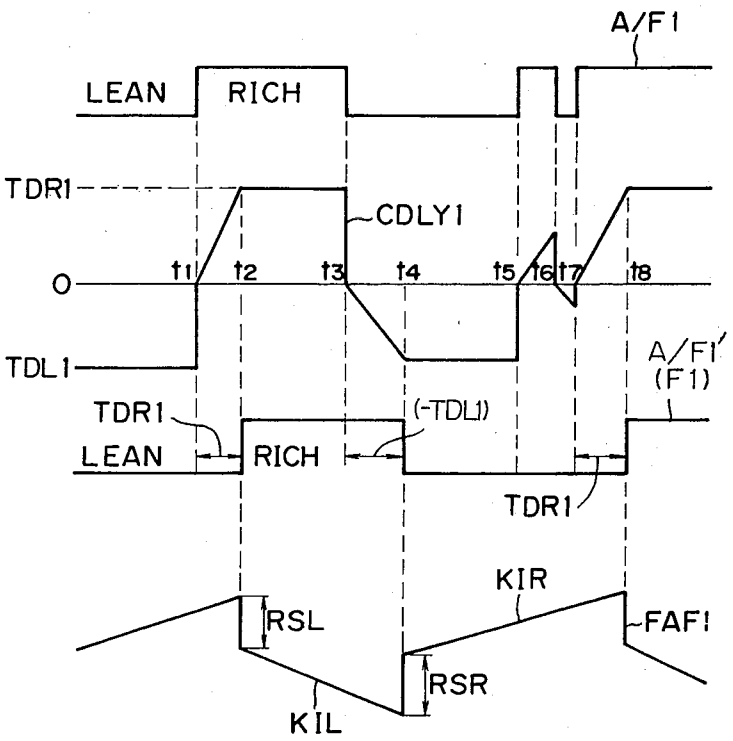
FIGS. 5A through 5D are timing diagrams explaining the flow chart of FIG. 3.

The operation by the flow chart of FIG. 3 will be further explained with reference to FIGS. 5A through 5D. As illustrated in FIG. 5A, when the air-fuel ratio A/F1 is obtained by the output of the upstream-side $O_2$ sensor 13, the first delay counter CDLY1 is counted up during a rich state, and is counted down during a lean state, as illustrated in FIG. 5B. As a result, a delayed air-fuel ratio corresponding to the first air-fuel ratio flag F1 is obtained as illustrated in FIG. 5C. For example, at time $t_1$, even when the air-fuel ratio A/F is changed from the lean side to the rich side, the delayed air-fuel ratio A/F1' (F1) is changed at time $t_2$after the rich delay time period TDR1. Similarly, at time $t_3$, even when the air-fuel ratio A/F1 is changed from the rich side to the lean side, the delayed air-fuel ratio F1 is changed at time $t_4$ after the lean delay time period TDL1. However, at time $t_5$, $t_6$, or $t_7$, when the air-fuel ratio A/F1 is reversed within a smaller time period than the rich delay time period TDR1 or the lean delay time period TDL1, the delay air-fuel ratio A/F1' is reversed at time $t_8$. That is, the delayed air-fuel ratio A/F1' is stable when compared with the air-fuel ratio A/F1. Further, as illustrated in FIG. 5D, at every change of the delayed air-fuel ratio A/F1' from the rich side to the lean side, or vice versa, the correction amount FAF1 is skipped by the skip amount RSR or RSL, and also, the correction amount FAF1 is gradually increased or decreased in accordance with the delayed air-fuel ratio A/F1'.

Air-fuel ratio feedback control operations by the downstream-side $O_2$ sensor 15 will be explained. There are two types of air-fuel ratio feedback control operations by the downstream-side $O_2$ sensor 15, i.e., the operation type in which a second air-fuel ratio correction amount FAF2 is introduced thereinto, and the operation type in which an air-fuel ratio feedback control parameter in the air-fuel ratio feedback control operation by the upstream-side $O_2$ sensor 13 is variable. Further, as the air fuel ratio feedback control parameter, there are nominated a delay time period TD (in more detail, the rich delay time period TDR1 and the lean delay time period TDL1), a skip amount RS (in more detail, the rich skip amount RSR and the lean skip amount RSL), an integration amount KI (in more detail, the rich integration amount KIR and the lean integration amount KIL), and the reference voltage $VR_1$.

For example, if the rich delay time period becomes larger than the lean delay time period (TDR>(−TDL1)), the controlled air-fuel ratio becomes richer, and if the lean delay time period becomes larger than the rich delay time period ((−TDL1)>TDR1), the controlled air-fuel ratio becomes leaner. Thus, the air-fuel ratio can be controlled by changing the rich delay time period TDR1 and the lean delay time period (−TDL1) in accordance with the output of the downstream-side $O_2$ sensor 15. Also, if the rich skip amount RSR is increased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the output of the down-stream-side $O_2$ sensor 15. Further, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIL in accordance with the output of the downstream-side $O_2$ sensor 15. Still further, if the reference voltage $VR_1$ is increased, the controlled air-fuel ratio becomes richer, and if the reference voltage $VR_1$ is decreased, the controlled air-fuel ratio becomes leaner. Thus, the air-fuel ratio can be controlled by changing the reference voltage $V_{R1}$ in accordance with the output of the downstream-side $O_2$ sensor 15.

A double $O_2$ sensor system into which a second air-fuel ratio correction amount FAF2 is introduced will be explained with reference to FIGS. 6, 7, and 8.

Figures 6, 6A:
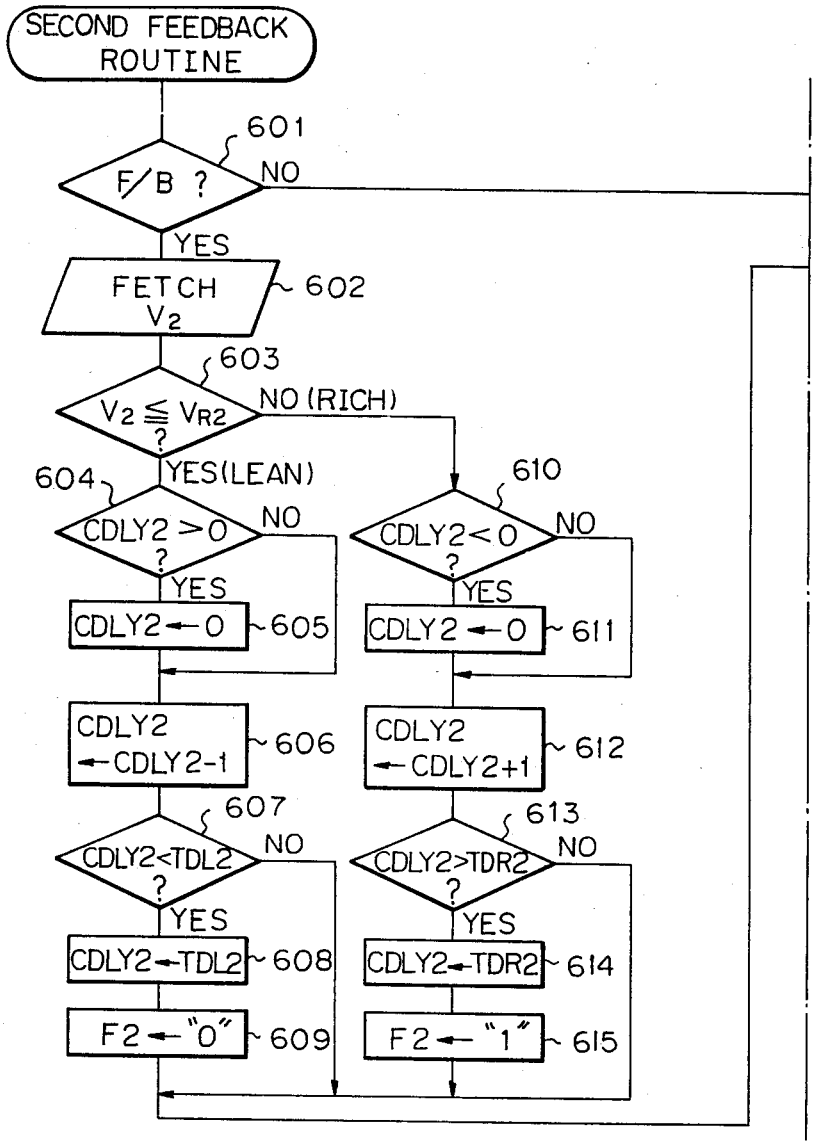
Figure 6B:
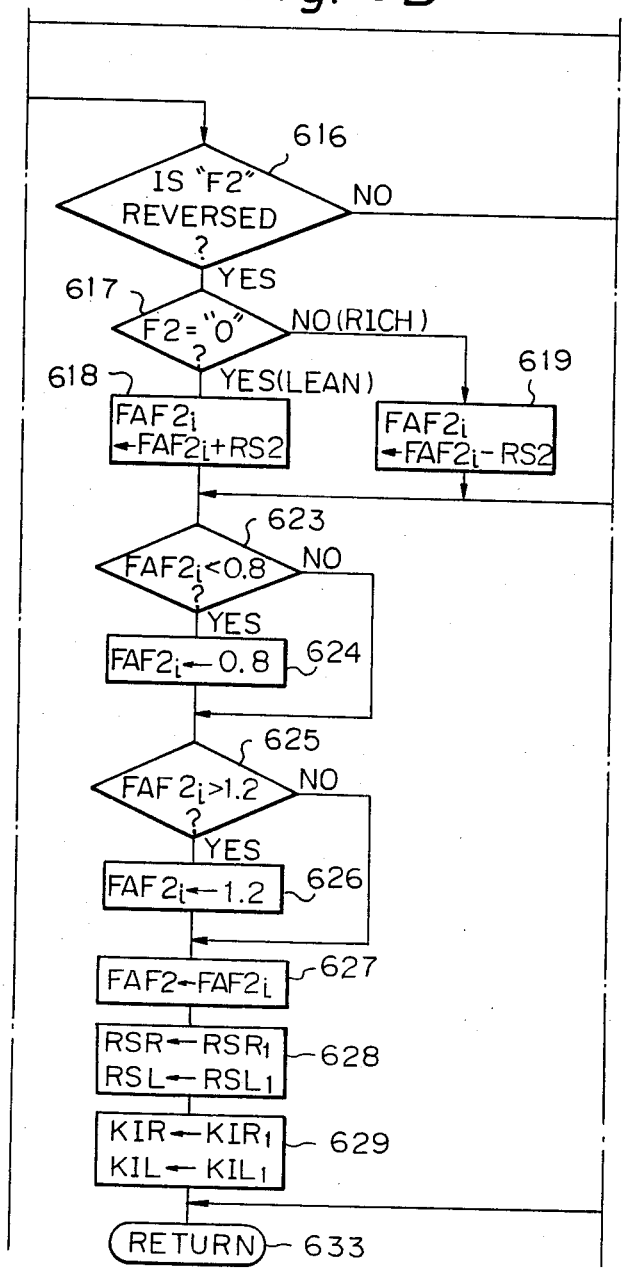
Figure 6C:
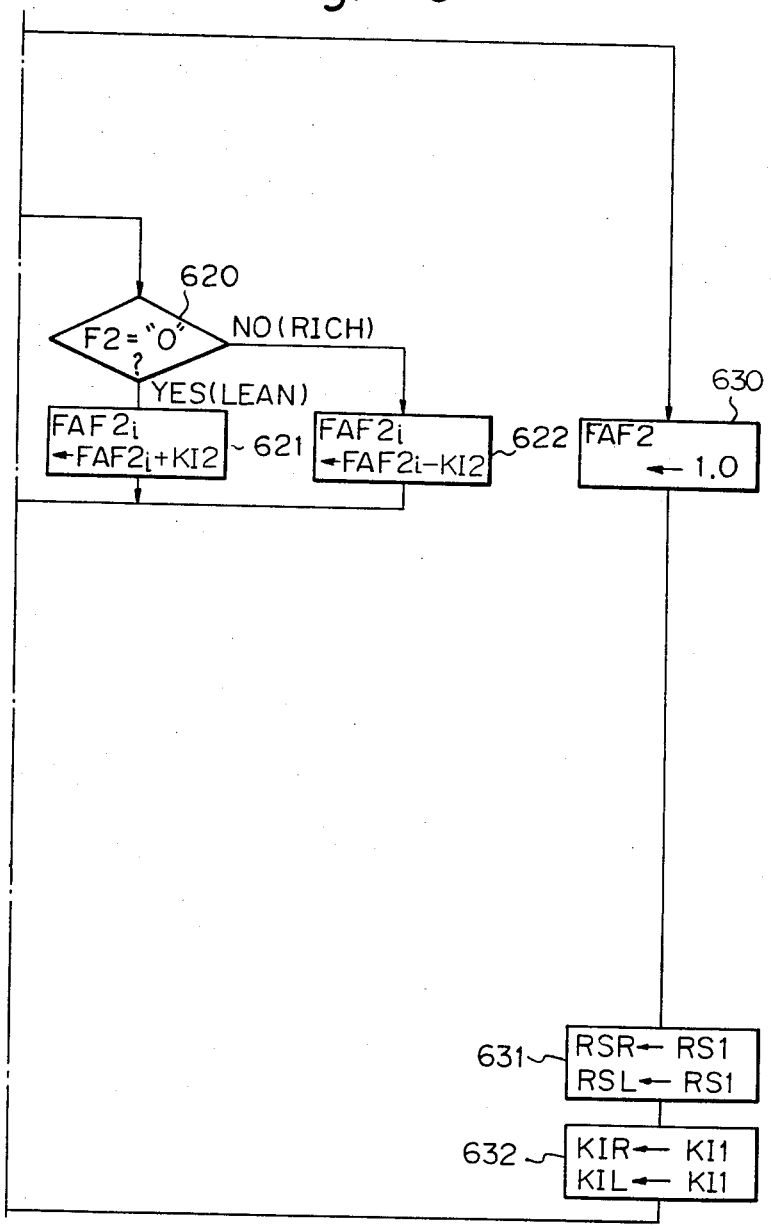

FIG. 6 is a routine for calculating a second air-fuel ratio feedback correction amount FAF2 in accordance with the output of the downstream-side $O_2$ sensor 15 executed at every predetermined time period such as 1 s. Note that, in this case, the learning control routine of FIG. 4A is used.

At step 601, it is determined all the feedback control (closed-loop control) conditions by the down-stream-side $O_2$ sensor 15 are satisfied. The feedback control conditions are as follows:

(i) the engine is not in a starting state;

(ii) the coolant temperature THW is higher then 50° C.; and (iii) the power fuel incremental amount FPOWER is 0.

Of course, other feedback control conditions are introduced as occasion demands. However, an explanation of such other feedback control conditions is omitted.

If one or more of the feedback control conditions is not satisfied, the control also proceeds to step 630, 631, and 632, thereby carrying out an open-loop control operation. That is, at step 630, the air-fuel ratio correction coefficient FAF2 is made 1.0. Note that this coefficient FAF2 can be the value thereof immediately before the open-loop control operation. In this case, step 630 is omitted. At step 631, the rich skip amount RSR and the lean skip amount RSL, are both caused to be a definite value RS1, i.e., RSR=RSL=RS1. Further, at step 632, the rich integration aount KIR and the lean integration amount KIL are both caused to be a definite value KI1, i.e., KIR=KIL=KI. According to steps 631 and 632, the air-fuel ratio feedback control by the upstream-side $O_2$ sensor 13 makes it possible that the first air-fuel ratio correction coefficient FAF1 is changed symmetrically with respect to its mean value, so that, if the air-fuel ratio feedback control by the downstream-side $O_2$ sensor 15 is opened, the mean value FAFAV calculated at step 401 of FIG. 4 exactly indicates a mean value of the first air-fuel ratio correction coefficient FAF1. Thus, the learning correction amount FGHAC can be prevented from being erroneously calculated.

Contrary to the above, at step 601, if all of the feedback control conditions are satisfied, the control proceeds to step 602.

At step 602, an A/D conversion is performed upon the output voltage $V_2$ of the downstream-side $O_2$ sensor 15, and the A/D converted value thereof is then fetched from the A/D converted value thereof is then fetched from the A/D converter 101. Then, at step 603, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $V_{R2}$ (0.55 V) is preferably higher than the reference voltage $V_{R1}$ (=0.45 V), in consideration of the difference in output characteristics and deterioration speed between the $O_2$ sensor 13 upstream of the catalyst converter 12 and the $O_2$ sensor 15 downstream of the catalyst converter 12.

Steps 604 through 615 correspond to step 304 through 315, respectively, of FIG. 3, thereby performing a delay operation upon the determination at step 603. Here, a rich delay time period is defined by TDR2, and a lean delay time period is defined by TDL2. As a result of the delayed determination, if the air-fuel ratio is rich a second air-fuel ratio flag F2 is made "1", and if the air-fuel ratio is lean, a second air-fuel ratio flag F2 is made "0".

Next, at step 616, it is determined whether or not the second air-fuel ratio flag F2 is reversed, i.e., whether or not the delayed air-fuel ratio detected by the downstream-side $O_2$ sensor 15 is reversed. If the second air-fuel ratio flag F2 is reversed, the control proceeds to steps 617 to 619 which carry out a skip operation. That is, if the flag F2 is "0" (lean) at step 617, the control proceeds to step 618, which remarkably increases a second correction amount FAF2i during an air-fuel ratio feedback control by a skip amount RS2. Also, if the flag F2 is "1" (rich) at step 617, the control proceeds to step 619, which remarkably decreases the second correction amount FAF2i by the skip amount RS2. On the other hand, if the second air-fuel ratio flag F2 is no reversed at step 616, the control proceeds to steps 620 to 622, which carries out an integration operation. That is, if the flag F2 is "0" (lean) at step 620, the control proceeds to step 621, which gradually increases the second correction amount FAF2i by an integration amount KI2. Also, if the flag F2 is "1" (rich) at step 620, the control proceeds to step 622, rich gradually decreases the second correction amount FAF2i by the integration amount KI2.

Note that the skip amount RS2 is larger than the integration amount KI2.

The second correction amount FAF2i is guarded by a minimum value 0.8 at steps 623 and 624, and by a maximum value 1.2 at steps 625 and 626, thereby also preventing the controlled air-fuel ratio from becoming overrich or overlean.

At step 62, the second air-fuel ratio correction coefficeitn FAF2i during an air-fuel ratio feedback control is cuased to be the second air-fuel ratio correction coefficient FAF2, i.e., FAF2 FAF2r.

At step 628, the rich skip amount RSR and the lean skip amont RSL are caused to be definite values $RSR_1$ and $RSL_1$ ($RSR_1$ 16 $RSL_1$ ) respectively, and at step 629, the rich integration, amount KIR and the lean integration amount KIL are caused to be definite values $KIR_1$ and $KIL_1$ ($KIR_1 \neq KIL_1$), respectively. Note that the values $RSR_1$, $RSL_1$ $KIR_1$ and $KIL_1$ are determined in view of the characteristics of the engine parts.

The correction amount FAF2, the skip amounts RSRi, RSLi, RSR, RSL, and the integration amounts KIRi, KILi, KIR, KIL is then stored in the RAM 105, thus completing this routine of FIG. 6 at step 633.

Figure 7:
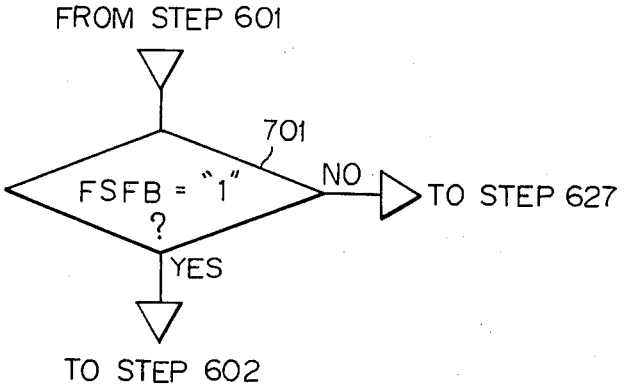

When the learning control routine of FIGS. 4B or 4C is used, the routine of FIG. 6 is modified by FIG. 7. That is, at step 701, it is determined whether or not the air-fuel ratio feedback control execution flag FSFB is "1". If FSFB="0", the control also proceeds to step 627 which carries out an open-loop control operation, in order to carry out a substantial learning control operation. Contrary to this, if FSFB="1", the control proceeds to step 602.

Figure 8:
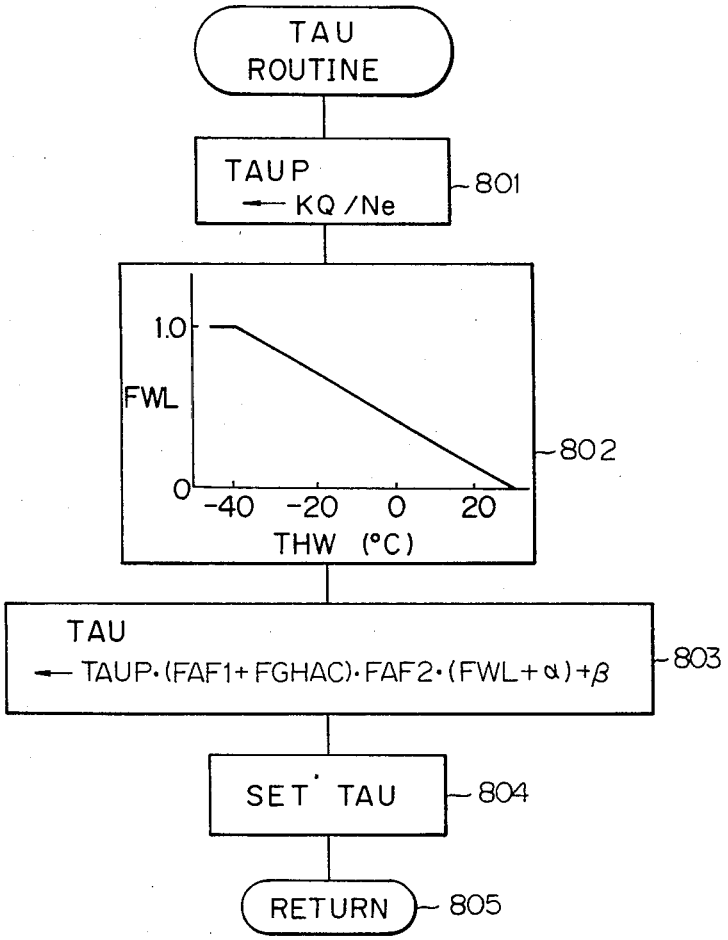

FIG. 8 is a routine for calculating a fuel injection amount TAU executed at every predetermined crank angle such as 360° CA. At step 801, a base fuel injection amount TAUP is calculated by using the intake air amount data Q and the engine speed data Ne stored in the RAM 105. That is, $$TAUP \leftarrow KQ/Ne$$

where K is a constant. Then at step 802, a warming-up incremental amount FWL is calculated from a one-dimensional map stored in the ROM 104 by using the coolant temperature data THW stored in the RAM 105. Note that the warming-up incremental amount FWL decreases when the coolant temperature THW increases. At step 803, a final fuel injection amount TAU is calculated by $$TAU \leftarrow TAUP \cdot (FAF1 + FGHAC) \cdot FAF2 \cdot (FWL + \alpha) + \beta$$

Where $\alpha$ and $\beta$ are correction factors determined by other parameters such as the voltage of the battery and the temperature of the intake air. At step 803, the final fuel injection amount TAU is set in the down counter 107, and in addition, the flip-flop 108 is set initiate the activation of the fuel injection valve 7. Then, this routine is completed by step 804. Note that, as explained above, when a time period corresponding to the amount TAU passes, the flip-flop 109 is reset by the carry-out signal of the down counter 108 to stop the activation of the fuel injection valve 7.

Figures 9A, 9B, 9C, 9D, 9E, 9F, 9G, 9H:
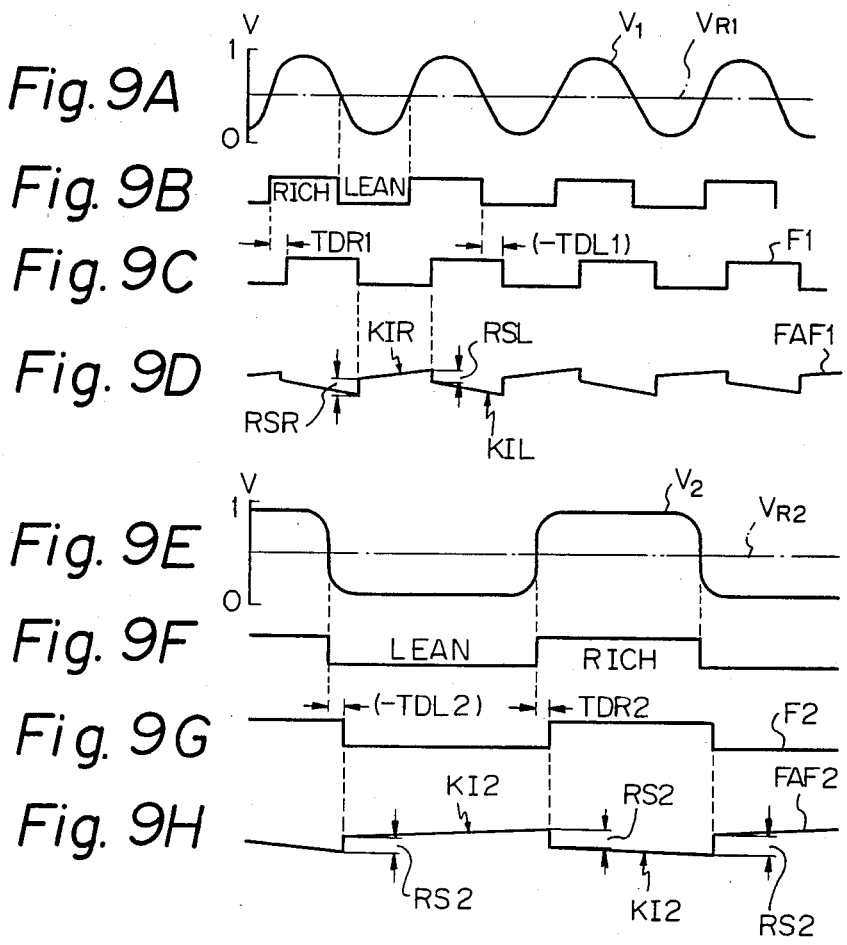
FIGS. 9A through 9H are timing diagrams explaining the flow charts of FIGS. 3, 4A, 4B, 4C, 6, and 8.

FIGS. 9A through 9H are timing diagrams for explaining the two air-fuel ratio correction amounts FAF1 and FAF2 obtained by the flow charts of FIGS. 3, 4A (4B, 4C) 6, and 8. In this case, the engine is in a closedloop control state for the two $O_2$ sensors 13 and 15. When the output of the upstream-side $O_2$ sensor 13 is changed as illustrated in FIG. 9A, the determination at step 303 of FIG. 3 is shown in FIG. 9B, and delayed determination thereof corresponding to the first air-fuel ratio flag F1 is shown in FIG. 9C. As a result, as shown in FIG. 9D, every time the delayed determination is changed from the rich side to the lean side, or vice versa, the first air-fuel ratio correction amount FAF1 is skipped by the amount RSR or RSL. On the other hand, when the output of the downstream-side $O_2$ sensor 15 is changed as illustrated in FIG. 9E, the determination at step 603 of FIG. 6 is shown in FIG. 9E, and the delayed determination thereof corresponding to the second air-fuel ratio flag F2 is shown in FIG. 9G. As a result, as shown in FIG. 9H, every time the delayed determination is changed from the rich side to the lean side, or vice versa, the second air-fuel ratio correction amount FAF2 is skipped by the skip amount RS2. Also, when the leaning control operation by the routine of FIG. 4B or 4C, the air-fuel ratio correction coefficient FAF2 is made 1.0.

A double $O_2$ sensor system, in which an air-fuel ratio feedback control parameter of the first air-fuel ratio feedback control by the upstream-side $O_2$ sensor is variable, will be explained with reference to FIGS. 10, 11, and 12. In this case, the skip amounts RSR and RSL as the air-fuel ratio feedback control parameters are variable.

Figures 10, 10A:
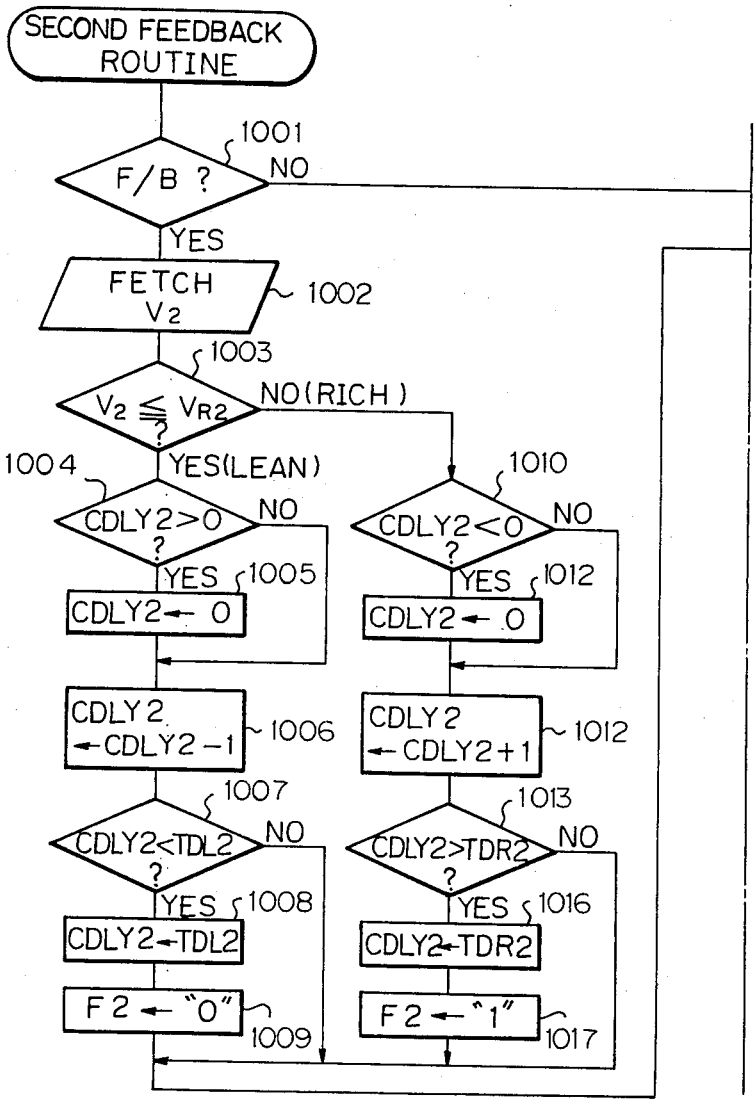
Figure 10B:
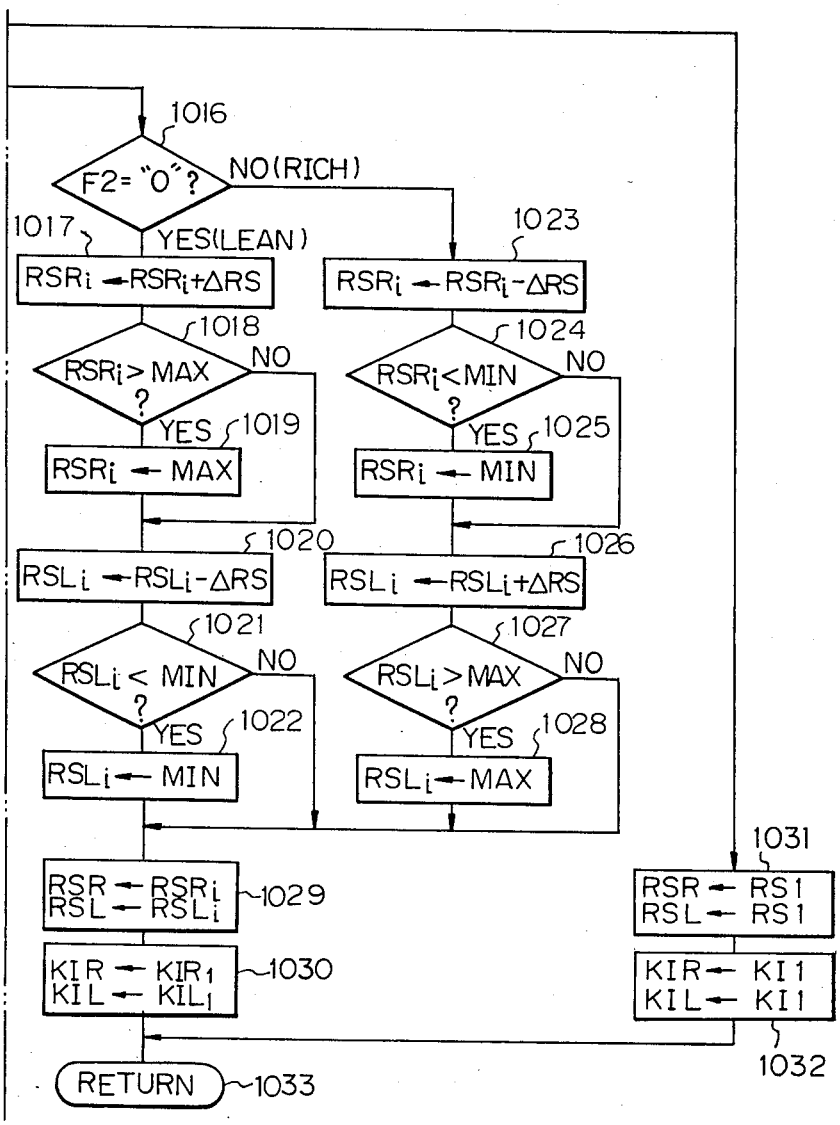

FIG. 10 is a routine for calculating the skip amounts RSR and RSL in accordance with the output of the downstream-side $O_2$ sensor 15 executed at every predetermined time period such as 1 s.

Steps 1001 through 1015 are the same as steps 601 through 615 of FIG. 6. That is, if one or more of the feedback control conditions is not satisfied, the control proceeds to steps 1031 and 1032, thereby carrying out an open-loop control operation. At step 1031, the rich skip amount RSR and the lean skip amount RSL are both caused to be a definite value RS1, i.e., RSR=RSL=RS1. Further, at step 1032, the rich integration amount KIR and the lean integration amount KIL are both caused to be a definite value KI1, i.e., KIR=KIL=KI1. As a result in the same was as in steps 631 and 632, the air-fuel ratio feedback control by the upstream-side $O_2$ sensor 13 makes it possible that the first air-fuel ratio correction coefficient FAF1 is chagned symmetrically with respect to its mean value, so that, if the air-fuel ratio feedback control by the downstream-side $O_2$ sensor 15 is opened, the mean value FAFAV calculated at step 401 of FIG. 4 exactly indicates a mean value of the first air-fuel ratio correction coefficient FAF1. Thus, the learning correction amount FGHAC can be prevented from being erroneously calculated.

Contrary to the above, if all of the feedback control conditions are satisfied, the second air-fuel ratio flag F2 is determined by the routine of steps 1002 through 1015.

At step 1016, it is determined whether or not the second air-fuel ratio F2 is "0". If F2="0", which means that the air-fuel ratio is lean, the control proceeds to steps 1017 through 1022, and if F2="1", which means that the air-fuel ratio is rich, the control proceeds to steps 1023 through 1028.

At step 1017, a rich skip amount RSRi during an air-fuel ratio feedback control is increased by a definite value ΔRS which is, for example, 0.08, to move the air-fuel ratio to the rich side. At steps 1018 and 1019, the rich skip amount $RSR_i$ is guarded by a maximum value MAX which is, for example, 6.2%. Further, at step 1020, a lean skip amount RSLi during an air-fuel ratio feedback control is decreased by the definite value ΔRS to move the air-fuel ratio to the lean side. At steps 1021 and 1022, the lean skip amount $RSL_i$ is guarded by a minimum value MIN which is, for example, 2.5%.

On the other hand, at step 1023, the rich skip amount $RSR_i$ is decreased by the definite value ΔRS to move the air-fuel ratio to the lean side. At steps 1024 and 1025, the rich skip amount $RSR_i$ is guarded by the minimum value MIN. Further, at step 1026, the lean skip amount RSLi is decreased by the definite value ΔRS to move the air-fuel ratio to the rich side. At steps 1027 and 1028, the lean skip amount $RSL_i$ is guarded by the maximum value MAX.

At steps 1029 and 1030, $$RSR \leftarrow RSR_i$$

$$RSR - RSL_i.$$

Note that, in this case, the rich skip amount RSR is different from the lean skip amount RSL, since the amounts RSRi and RSLi are variable. Then, at step 1030, the rich integration amount KIR and the lean integration amount KIL are caused to be definite values $KIR_1$ and $KIL_1$ ($KIR_1 \neq KIL_1$), respectively. Note that the values $KIR_1$ and $KIL_1$ are determined in view of the characteristics of the engine parts.

The skip amounts $RSR_i$ and $RSL_i$ and RSR and RSL, the integration amounts KIR and KIL are then stored in the RAM 105, thereby completing this routine of FIG. 10 at step 1033.

Figure 11:
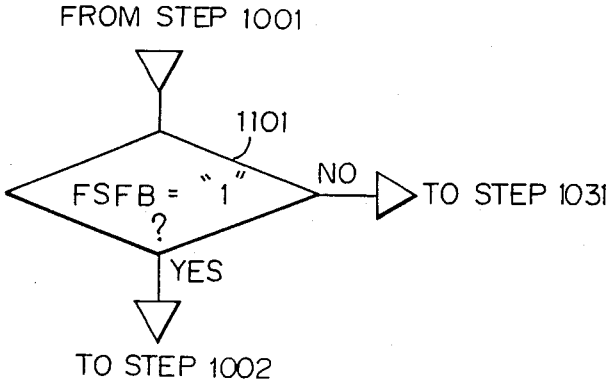

When the learning control routine of FIG. 4B or 4C is used, the routine of FIG. 10 is modified by FIG. 11. That is, at step 1101, it is determined whether or not the air-fuel ratio feedback control execution flag FSFB is "1". If FSFB="0", the control also proceeds to step 1031 which carries out an open-loop control operation, in order to carry out a substantial learning control operation. Contrary to this, if FSFB="1", the control proceeds to step 1002.

Figure 12:
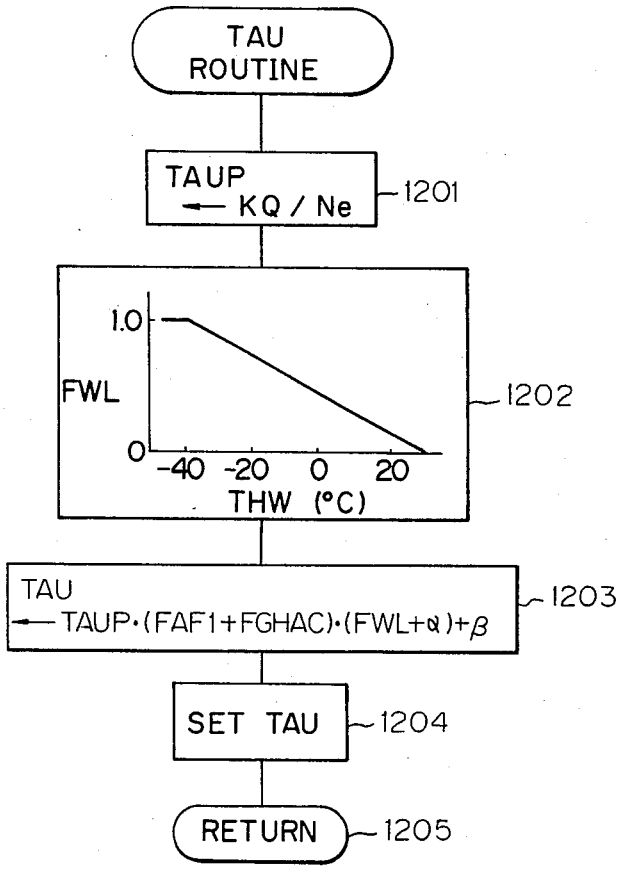

FIG. 12 is a routine for calculating a fuel injection amount TAU executed at every predetermined crank angle such as 360° CA. At step 1201, a base fuel injection amount TAUP is calculated by using the intake air amount data Q and the engine speed data Ne stored in the RAM 105. That is, $$TAUP \leftarrow KQ/Ne$$

where K is a constant. Then at step 1202, a warming-up incremental amount FWL is calculated from a one-dimensional map by using the coolant temperature data THW stored in the RAM 105. Note that the warming-up incremental amount FWL decreases when the coolant temperature THW increases. At step 1203, a final fuel injection amount TAU is calculated by $$TAU \leftarrow TAUP \cdot (FAF1 + FGHAC) \cdot (FWL + \alpha) + \beta$$

where $\alpha$ and $\beta$ are correction factors determined by other parameters such as the voltage of the battery and final fuel injection amount TAU is set in the down counter 108, and in addition, the flip-flop 109 is set to initiate the activation of the fuel injection valve 7. Then this routine is completed by step 1205. Note that, as explained above, when a time period corresponding to the amount TAU has passed, the flip-flop 109 is reset by the carry-out signal of the down counter 108 to stop the activation of the fuel injection valve 7.

Figures 13A, 13B, 13C, 13D, 13E, 13F, 13G, 13H, 13I:
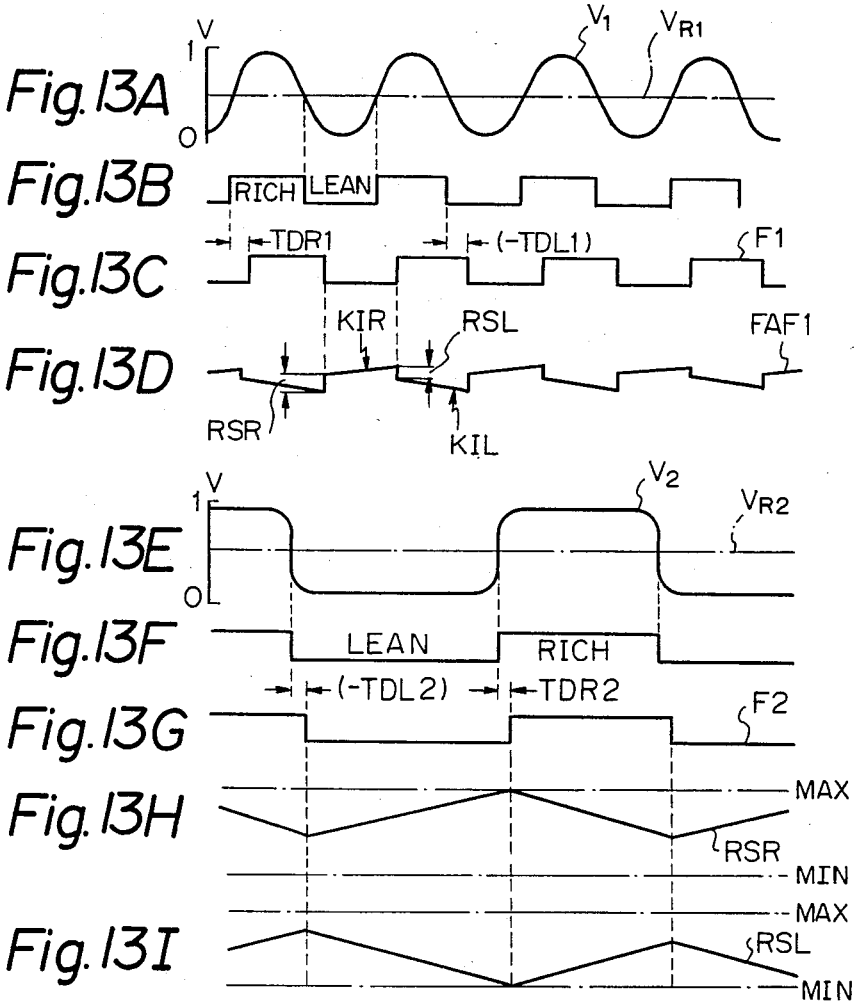
FIGS. 13A through 13I, 14A, 14B, and 14C are timing diagrams explaining the flow charts of FIGS. 3, 4A, 4B, 4C, 10 and 12 and FIGS. 16A through 16D are timing diagrams explaning the flow chart of FIG. 15.

FIGS. 13A through 13I are timing diagrams for explaining the air-fuel ratio correction amount FAF1 and the skip amounts RSR and RSL obtained by the flow charts of FIGS. 3, 4A (4B, 4C) 10, and 11. FIGS. 13A through 13G are the same as FIGS. 9A through 9G, respectively. As shown in FIGS. 13H and 13I, when the delayed determination F2 is lean, the rich skip amount RSR is increased and the lean skip amount RSL is decreased, and when the delayed determination F2 is rich, the rich skip amount RSR is decreased and the lean skip amount RSL is increased. In this case, the skip amounts RSR and RSL are changed within a range from MAX to MIN. Also, when the learning control operation by the routine of FIG. 4B or 4C, the skip amounts RSR and RSL are both caused to be 5%.

Note that the calculated parameters FAF1 and FAF2, or FAF1 , $RSR_i$ and $RSL_i$ can be stored in the backup RAM 106, thereby improving drivability at the re-staring of the engine.

Figures 14A, 14B, 14C:
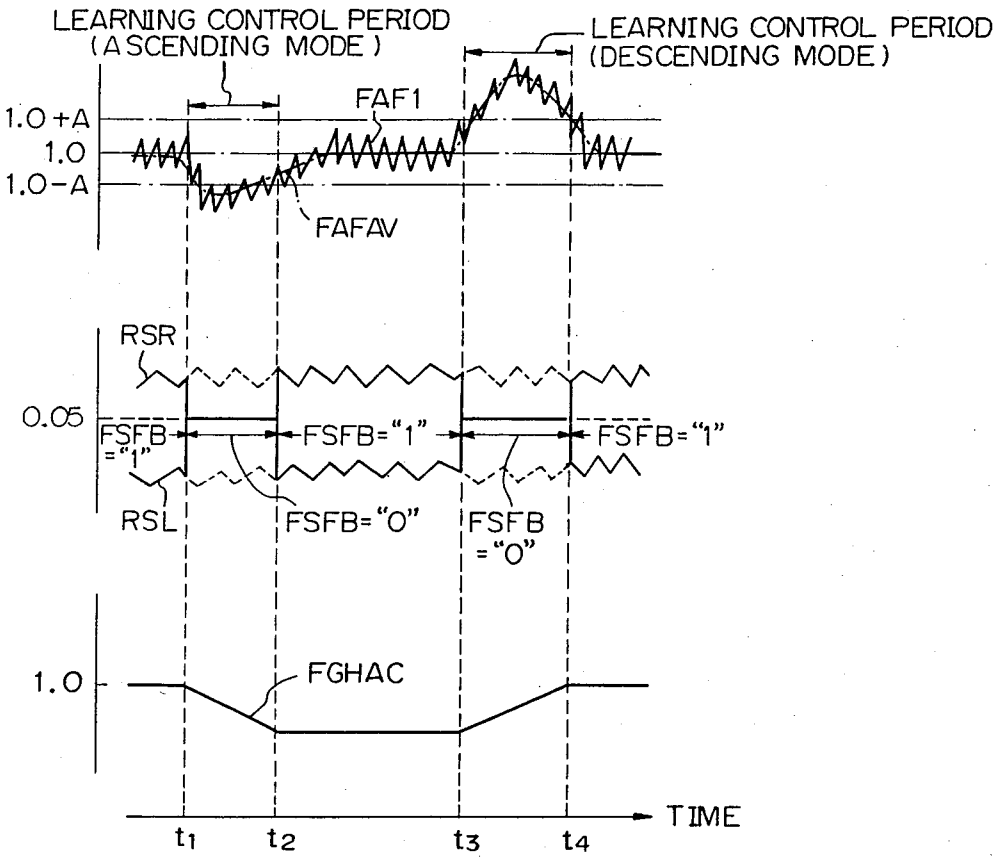

FIGS. 14A, 14B, and 14C are also timing diagrams for explaining the air-fuel ratio correction amount FAF1 and the skip amounts RSR and RSL obtained by the flow charts of FIGS. 3, 4B (4C), 10, and 11. That is, when the air-fuel ratio correction coefficient FAF1 is changed as indicated by a solid line in FIG. 14A, the means value FAFAV of the air-fuel ratio correction coefficient FAF1 is changed as indicated by a dotted line in FIG. 14A. However, until the means value FAFAV exceeds the value 1.0−A or 1.0−A, a substantial learning control is not carried out, i.e., the leaning correction amount FGHAC is not renewed. Therefore, until time $t_1$, the learning correction amount FGHAC remains at a definite value, but an air-fuel ratio feedback control by the two $O_2$ sensors 13 and 15 is carried out. When the means value FAFAV becomes smaller than the value 1.0−A, which means that a change of the intake air density in an ascending mode has occurred, a substantial learning control operation is carried out to reduce the learning correction amount FGHAC from time $t_1$ to time $t_2$. In this case, the skip amounts RSR and RSL are made variable by the routine of FIG. 4A, while the skip amounts RSR and RSL are fixed to a definite value by the routine of FIG. 4B or 4C. Similarly, when the means value FAFAV becomes larger than the value 1.0+A, which means that a change of the intake air density in a descending mode has occurred, a substantial learning control operation is carried out to increase the learning correction amount FGHAC from time $t_3$ to time $t_4$. Also, in this case, the skip amounts RSR and RSL ar made variable by the routine of FIG. 4A, while the skip amounts RSR and RSL are fixed to a definite value by the routine of FIG. 4B or 4C.

Figure 15:
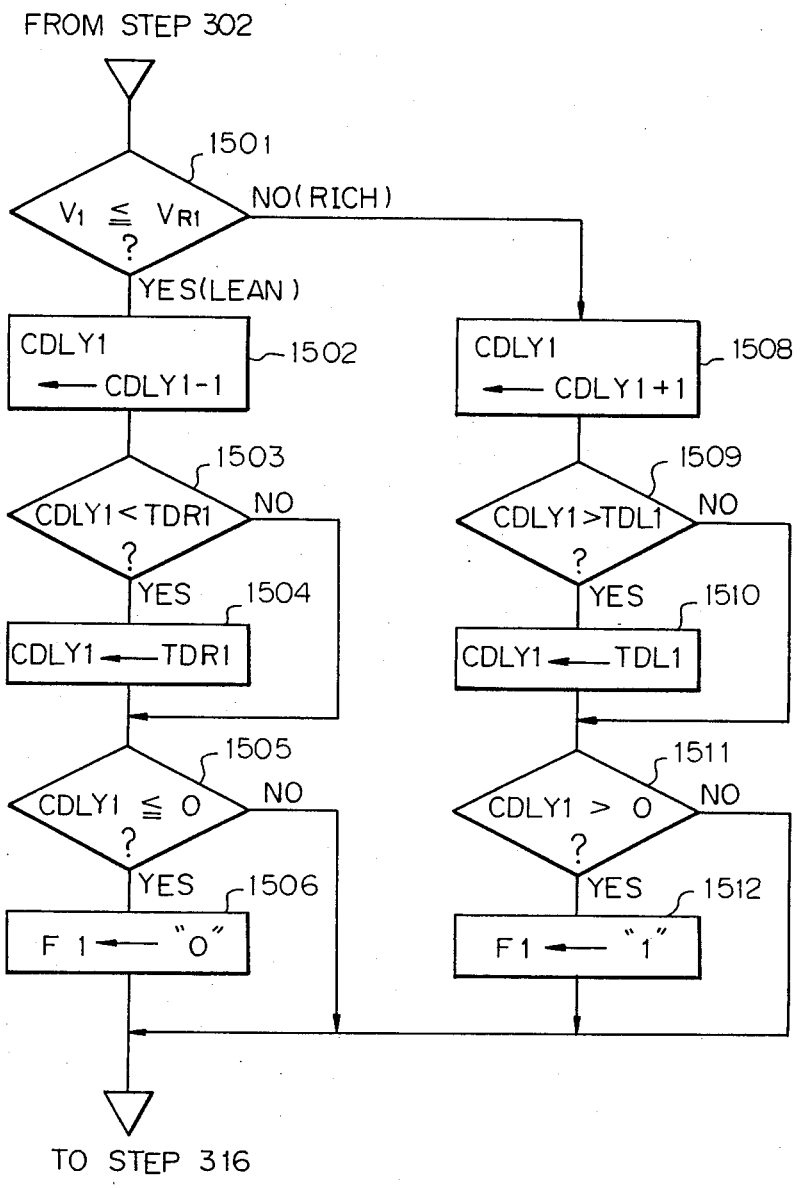

In FIG. 15, which is a modification of FIG. 3, a delay operation different from the of FIG. 3 is carried out. That is, at step 1501, if $V_1 \leqq = V_{R1}$, which means that the current air-fuel ratio is lean, the control proceeds to steps 1502 which decreases a first delay counter CDLY1 by 1. Then, at step 1503 and 1504, the first delay counter CDLY1 is guarded by a minimum value TDR1. Note that TDR1 is a rich delay time period for which a lean state is maintained even after the output of the upstream-side $O_2$ sensor 13 is changed from the lean side to the rich side, and is defined by a negative value.

Note that, in this case, if CDLY1>0, then the delayed air-fuel ratio is rich, and if CDLY<0, then the delayed air-fuel ratio is lean.

Therefore, at step 1505, it is determined whether or not CDLY≦0 is satisfied. As a result, if CDLY1 <0, at step 1506, the first air-fuel ratio flag F1 is caused to be "0" (lean). Otherwise, the first air-fuel ratio flag F1 is unchanged, that is, the flag F1 remains at "1".

On the other hand, if $V_1 > V_{R1}$, which means that the current air-fuel ratio is rich, the control proceeds to step 1508 which increases the first delay counter CDLY1 by 1. Then, at steps 1509 and 1510, the first delay counter CDLY1 is guarded by a maximum value TDL1. Note that TDL1 is a lean delay time period for which a rich state is maintained even after the output of the upstream-side $O_2$ sensor 13 is changed from the rich side to the lean side, and is defined by a positive value.

Then, at step 1511, it is determined whether or not CDLY1>0 is satisfied, As a result if CDLY1>0, at step 1512, the first air-fuel ratio flag F1 is caused to be "1" (rich). Otherwise, the first air-fuel ratio F1 is unchanged, that is, the flag F1 remains at "0".

Figures 16A, 16B, 16C, 16D:
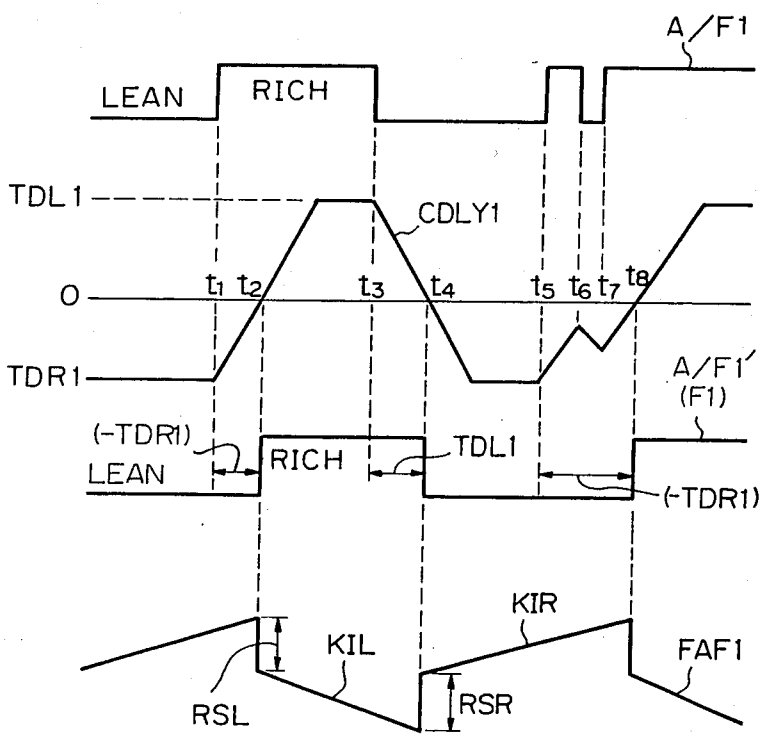

The operation by the flow chart of FIG. 15 will be further explained with reference to FIGS. 16A through 16D. As illustrated in FIG 16A, when the air-fuel ratio A/F1 is obtained by the output of the upstream-side $O_2$ sensor 13, the first delay counter CDLY1 is counted up during a rich state, and is counted down during a lean state, as illustrated in FIG. 16B. As a result, the delayed air-fuel ratio A/F1' is obtained as illustrated in FIG. 16C. For example, at time $t_1$, even when the air fuel ratio A/F1 is changed from the lean side to the rich side, the delayed air-fuel ratio A/F1 is changed at time $t_2$ after the rich delay time period TDR1. Similarly, at time $t_3$, even when the air-fuel ratio A/F1 is changed from the rich side to the lean side, the delayed air-fuel ratio A/F1' is changed at time $t_4$ after the lean delay time period TDL1. However, at time $t_5$, $t_6$, or $t_7$, when the air-fuel ratio A/F is reversed within a smaller time period than the rich delay time period TDR1 or the lean delay time period TDL1, the delayed air-fuel ratio A/F1' is reversed at $t_8$. That is, the delayed air-fuel ratio A/F1' is stable when compared with the air-fuel ratio A/F1. Further, as illustrated in FIG. 16D. at every change of the delayed air-fuel ratio A/F1' from the rich side to the lean side, or vice versa, the correction amount FAF1 is skipped by the skip amount RSR or RSL, and also, the correction amount FAF1 is gradually increased or decreased in accordance with the delayed air-fuel ratio A/F1'.

Note that, in this case, during an open-control mode, the rich delay time period TDR1 is, for example, −12 (48 ms), and the lean delay time period TDL1 is, for example, 6 (24 ms).

Figure 17:
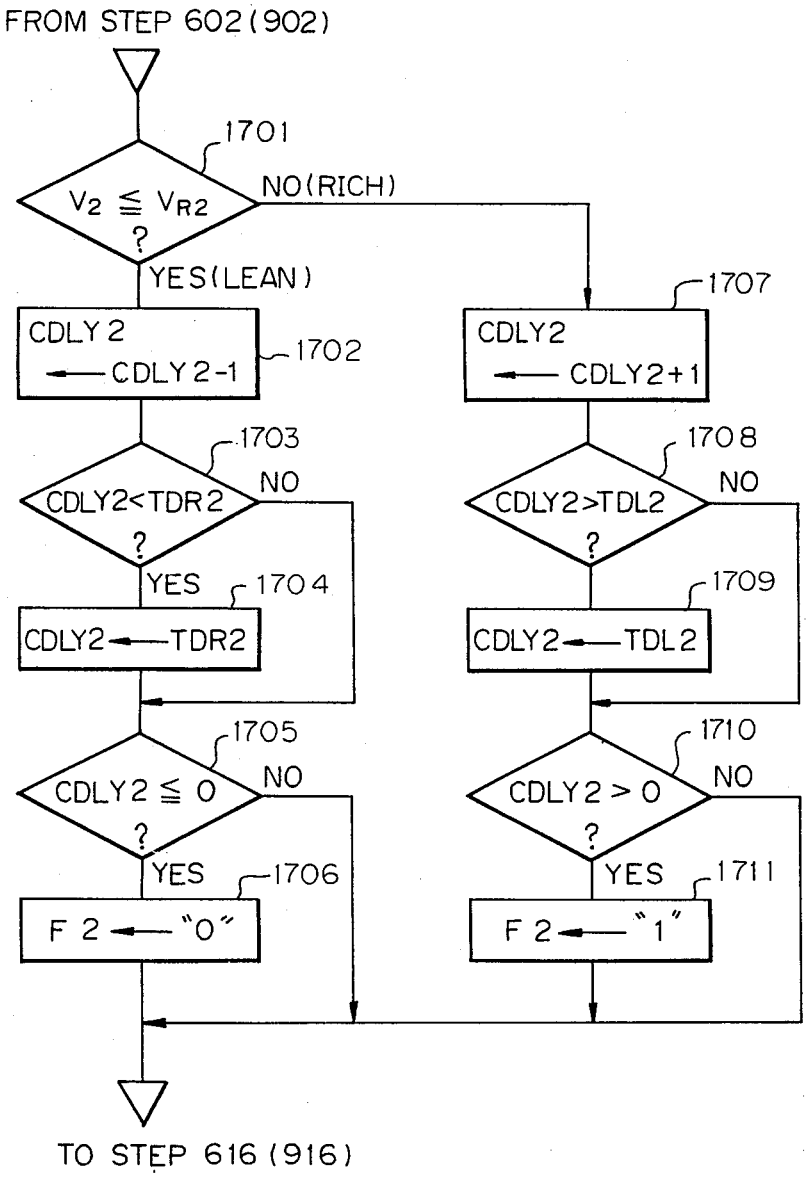

In FIG. 17, which is a modification of FIG. 6 or 10, the same delay operation as in FIG. 15 is carried out, and therefore, a detailed explanation thereof is omitted.

Also, the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. That is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the skip amounts RSR and RSL, the integration amounts KIR and KIL, or the reference voltage $V_{R1}$, are variable.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 801 of FIG. 8 or at step 1201 of FIG. 2 is determined by the carburetor itself, i.e., the intake air negative pressure and the engine speed, and the air amount corresponding to TAU at step 803 of FIG. 8 of at step 1203 of FIG. 12.

Further, a CO sensor, a lean-mixture sensor or the like can be also used instead of the $O_2$ sensor.

As explained above, according to the present invention, only when a change occurs in the intake air density is a substantial learning control operation performed upon the learning correction amount FGHAC, thereby compensating for such a change in the intake air density. As a result, the fuel consumption, the drivability, and the condition of the exhaust gas can be improved.

We claim:

1. A method for controlling an air-fuel ratio in an internal combustion engine having a catalyst converter for removing pollutants in the exhaust gas thereof, and upstream-side and downstream-side air-fuel ratio sensors disposed upstream and downstream, repsectively, of said catalyst converter, for detecting a concentration of a specific component in the exhaust gas, comprising the steps of:

calculating a first air-fuel ratio correction amount in accordance with the output of said upstream-side air-fuel ratio sensor;

calculating a second air-fuel ratio correction amount in accordance with the output of said downstream-side air-fuel ratio sensor;

determining whether or not a change of density of air taken into said engine is larger than a predetermined value;

calculating a learning correction amount so that a mean value of said first air-fuel ratio correction amount is brought close to a reference value, when the change of the intake air density is larger than said predetermined value;

adjusting an actual air-fuel ratio in accordance with said first and second air-fuel ratio correction amounts, and said learning correction amount.

2. A method as set forth in claim 1, further comprising a step of delaying the determination result at said intake air density change determining step.

3. A method as set forth in claim 1, wherein said intake air density change determining step comprises the steps of:

calculating a difference between said mean value of said first air-fuel ratio correction amount and said reference value; and determining whether or not said differrence is larger than a predetermined difference, thereby determining that the change of the intake air density is larger than said predetermined value.

4. A method as set forth in claim 1, wherein said intake air density change determining step comprises a step of determining whether the change of said mean value of said first air-fuel ratio correction amount is larger than a definite value, thereby determining that the change of the intake air density is large.

5. A method as set forth in claim 1, further comprising a step of prohibiting the calculation of said second air-fuel ratio correction amount when said learning correction amount calculating step calculates said learning correction amount.

6. A method as set forth in claim 5, wherein said first air-fuel ratio correction amount calculating step comprises a step of controlling said first air-fuel ratio correction amount symmetrically with respect to said mean value thereof, when said learning correction amount calculating step calculates said learning correction amount.

7. A method as set forth in claim 5, wherein said second air-fuel ratio correction amount calculating step comprises a step of holding said air-fuel ratio correction amount at its amount immediately before said prohibiting step prohibits the calculation of said second air-fuel ratio correction amount, when said learning correction amount calculating step calculates said learning correction amount.

8. A method for controlling an air-fuel ratio in an internal combustion engine ha vinga catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

calculating an air-fuel ratio feedback control parameter in accordance with the output of said downstream-side air-fuel ratio sensor;

calculating an air-fuel ratio correction amount in accordance with the output of said upstream-side air-fuel ratio sensor and said air-fuel ratio feedback control parameter;

determining whether or not a change of density of air taken into said engine is larger than a predetermined value;

calculating a learning correction amount so that a means value of said air-fuel ratio correction amount is brought close to a reference value, when the change of the intake air density is larger than said predetermined value;

adjusting an actual air-fuel ratio in accordance with said air-fuel ratio correction amount and said learning correction amount.

9. A method as set forth in claim 8, further comprising a step of delaying the determination result at said intake air density change determining step.

10. A method as set forth in claim 8, wherein said intake air density change determining step comprises the steps of:

calculating a difference between said mean value of said air-fuel correction amount and said reference value; and determining whether or not said difference is larger than a predetermined difference, thereby determining that the change of the intake air density is larger than said predetermined value.

11. A method as set forth in claim 8, wherein said intake air density change determining step comprises a step of determining whether the change of said mean value of said air-fuel ratio correction amount is larger than a definite value, thereby determining that the change of the intake air density is larger than said predetermined value.

12. A method as set forth in claim 8, further comprising a step of prohibiting the calculation of aid air-fuel ratio feedback control parameter when said learning correction amount calculating step calculates said learning correction amount.

13. A method as set forth in claim 12, wherein said air-fuel ratio feedback control parameter calculating step holds said air-fuel ratio feedback control parameter so that said air-fuel ratio correction amount is changed symmetrically with respect to said mean value thereof, when said learning correction amount calculating step calculates said learning correction amount.

14. A method as set forth in claim 12, wherein said air-fuel ratio feedback control parameter calculating step comprises a step of holding said air-fuel ratio feedback control parameter at is value immediately before said prohibiting step prohibits the calculation of said second air-fuel ratio correction amount, when said learning correction amount calculating step calculates said learning correction amount.

15. A method as set forth in claim 8, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

16. A method as set forth in claim 8, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

17. A method as set forth in claim 8, wherein said air-fuel ratio feedback control parameter is determined by a rich delay time period for delaying the output of said upstream-side air-fuel ratio sensor switched from the lean side to the rich side and a lean delay time period of delaying the output of said upstream-side air-fuel ratio sensor switched from the rich side to the lean side.

18. A method as set forth in claim 8, wherein said air-fuel ratio feedback control parameter is determined by a reference voltage with which the output of said upstream-side air-fuel ratio sensor is compared, thereby determining whether the air-fuel ratio is on the rich side or on the lean side.

19. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively of said catalyst converter, for detecting a concentration of a specific component in the exhaust gas, comprising:

means for calculating a first air-fuel ratio correction amount in accordance with the output of said upstream-side air-fuel ratio sensor;

means for calculating a second air-fuel ratio correction amount in accordance with the output of said downstream-side air-fuel ratio sensor;

means for determining whether or not a change of density of air taken into said engine is larger than a predetermined value;

means for calculating a learning correction amount so that a mean value of said first air-fuel ratio correction amount is brought close to a reference value, when the change of the intake air density is larger than said predetermined value;

means for adjusting an actual air-fuel ratio in accordance with said first and second air-fuel ratio correction amounts, and said learning correction amount.

20. An apparatus as set forth in claim 19, further comprising means for delaying the determination result at said intake air density change determining means.

21. An apparatus as set forth in claim 19, wherein said intake air density change determining means comprises:

means for calculating a difference between said mean value of said first air-fuel ratio correction amount and said reference value; and means for determining whether or not said difference is larger than a predetermined difference, thereby determining that the change of the intake air density is larger than said predetermined value.

22. An apparatus as set forth in claim 19, wherein said intake air density change determining means comprises means for determining whether the change of said means value of said first air-fuel ratio correction amount is larger than a definite value, thereby determining that the change of the intake air density is larger than said predetermined value.

23. An apparatus as set forth in claim 19, further comprising means for prohibiting the calculation of said second air-fuel ratio correction amount when said learning correction amount calculating means calculates said learning correction amount.

24. An apparatus as set forth in claim 23, wherein said first air-fuel ratio correction amount calculating means comprises means for controlling said first air-fuel ratio correction amount symmetrically with respect to said mean value thereof, when said learning correction amount calculating means calculates said learning correction amount.

25. An apparatus as set forth in claim 23, wherein said second air-fuel ratio correction amount calculating means comprises means for holding said air-fuel ratio correction amount at its amount immediately before said prohibiting means prohibits the calculation of said second air-fuel ratio correction amount, when said learning correction amount calculating means calculates said learning correction amount.

26. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst cnverter, for detecting a concentration of a specific component in the exhaust gas, comprising:

means for calculating an air-fuel ratio feedback control parameter in accordance with the output of said downstream-side air-fuel ratio sensor;

means for calculating an air-fuel ratio correction amount in accordance with the output of said upstream-side air-fuel ratio sensor and said air-fuel ratio feedback control parameter;

means for determining whether or not a change of density of air taken into said engine is larger than a predetermined value;

means for calculating a learning correction amount so that a mean value of said air-fuel ratio correction amount is brought close to a reference value, when the change of the intake air density is larger than said predetermined value;

means for adjusting an actual air-fuel ratio in accordance with said air-fuel ratio correction amount and said learning correction amount.

27. An apparatus as set forth in claim 26, further comprising means for delaying the determination result at said intake air density change determining means.

28. An apparatus as set forth in claim 26, wherein said intake air density change determining means comprises:

means for calculating a difference between said mean value of said air-fuel ratio correction amount and said reference value; and means for determining whether or not said difference is larger than a predetermined difference, thereby determining that the change of the intake air density is larger than said predetermined value.

29. An apparatus as set forth in claim 26, wherein said intake air density change determining means comprises means for determining whether the change of said mean value of said air-fuel ratio correction amount is larger than a definite value, thereby determining that the change of the intake air density is larger than said predetermined value.

30. An apparatus as set forth in claim 26, further comprising means for prohibiting the calculation of said air-fuel ratio feedback control parameter when said learning correction amount calculating means calculates said learning correction amount.

31. An apparatus as set forth in claim 30, wherein said air-fuel ratio feedback control parameter calculating means holds said air-fuel ratio feedback control parameter so that said air-fuel ratio correction amount is changed symmetrically with respect to said mean value thereof, when said learning correction amount calculating means calculates said learning correction amount.

32. An apparatus as set forth in claim 30, wherein said air-fuel ratio feedback control parameter calculating means comprises means for holding said air-fuel ratio feedback control parameter at its value immediately before said prohibiting means prohibits the calculation of said second air-fuel ratio correction amount, when said learning correction amount calculating means calculates said learning correction amount.

33. A method as set forth in claim 26, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

34. A method as set forth in claim 26, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

35. A method as set forth in claim 26, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

36. A method as set forth in claim 26, wherein said air-fuel ratio feedback control parameter is determined by a reference voltage with which the output of said upstream-side air-fuel ratio sensor is compared, thereby determining whether the air-fuel ratio is on the rich side or on the lean side.

* * * * *